US009857113B2

(12) United States Patent
Morimoto et al.

(10) Patent No.: US 9,857,113 B2
(45) Date of Patent: Jan. 2, 2018

(54) AIR-CONDITIONING APPARATUS

(75) Inventors: Hiroyuki Morimoto, Tokyo (JP); Koji Yamashita, Tokyo (JP); Yoshihiro Sumida, Tokyo (JP); Yusuke Shimazu, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 243 days.

(21) Appl. No.: 14/114,788

(22) PCT Filed: Jun. 16, 2011

(86) PCT No.: PCT/JP2011/003442

§ 371 (c)(1),
(2), (4) Date: Dec. 6, 2013

(87) PCT Pub. No.: WO2012/172611

PCT Pub. Date: Dec. 20, 2012

(65) Prior Publication Data

US 2014/0096551 A1 Apr. 10, 2014

(51) Int. Cl.
*G01K 13/00* (2006.01)
*F25B 49/02* (2006.01)
(Continued)

(52) U.S. Cl.
CPC ..... *F25B 49/02* (2013.01); *F25B 9/006* (2013.01); *F25B 13/00* (2013.01);
(Continued)

(58) Field of Classification Search
CPC ..... F25B 49/02; F25B 9/006; F25B 2500/19; F25B 2600/21
See application file for complete search history.

(56) References Cited

U.S. PATENT DOCUMENTS 5,626,026 A * 5/1997 Sumida ..... F25B 9/006 62/129
5,996,358 A * 12/1999 Sumida ..... C09K 5/045 62/114
(Continued)

FOREIGN PATENT DOCUMENTS

EP 0 693 663 A2 1/1996
EP 0 898 133 A2 2/1999
(Continued)

OTHER PUBLICATIONS

Shinichi et al., Air Conditioner, Nov. 5, 2009, WO2009133640A1, Whole Document.*
(Continued)

*Primary Examiner* — Larry Furdge
(74) *Attorney, Agent, or Firm* — Posz Law Group, PLC

(57) ABSTRACT

A computing device calculates a quality of a refrigerant flowing out of a second expansion device on the basis of an inlet liquid enthalpy calculated on the basis of a temperature of the refrigerant flowing into the second expansion device and a saturated gas enthalpy and a saturated liquid enthalpy calculated on the basis of a temperature of the refrigerant flowing out of the second expansion device or a pressure of the refrigerant sucked into a compressor; calculates a liquid-phase concentration and a gas-phase concentration of the refrigerant flowing out of the second expansion device on the basis of the temperature of the refrigerant flowing out of the second expansion device and the pressure of the refrigerant sucked into the compressor; and calculates a composition of the refrigerant circulating in a refrigeration cycle on the basis of the calculated quality, liquid-phase concentration, and gas-phase concentration.

7 Claims, 14 Drawing Sheets

(51) Int. Cl.
*F25B 9/00* (2006.01)
*F25B 13/00* (2006.01)

(52) U.S. Cl.
CPC ... *F25B 2313/0231* (2013.01); *F25B 2400/12* (2013.01); *F25B 2400/121* (2013.01); *F25B 2500/19* (2013.01); *F25B 2600/21* (2013.01); *F25B 2700/1933* (2013.01); *F25B 2700/21174* (2013.01)

(56) References Cited

U.S. PATENT DOCUMENTS

| | | | | |
|---|---|---|---|---|
| 6,192,696 | B1 * | 2/2001 | Shimamoto | C09K 5/045 62/209 |
| 6,393,850 | B1 * | 5/2002 | Vanderstraeten | B01D 5/0039 62/196.3 |
| 6,837,063 | B1 * | 1/2005 | Hood | F25B 25/00 165/104.21 |
| 2009/0000322 | A1 * | 1/2009 | Hatakeyama | B60H 1/3208 62/228.3 |

FOREIGN PATENT DOCUMENTS

| | | | | |
|---|---|---|---|---|
| JP | 08-075280 | A | | 3/1996 |
| JP | 08-261576 | A | | 10/1996 |
| JP | 09-014770 | A | | 1/1997 |
| JP | 11-063747 | A | | 3/1999 |
| JP | 2008-196829 | A | | 8/2008 |
| JP | 2009-222356 | A | | 10/2009 |
| WO | WO2009133640 | A1 | * | 11/2009 |
| WO | 2011/064814 | A1 | | 6/2011 |
| WO | WO2012101676 | A1 | * | 8/2012 |

OTHER PUBLICATIONS

Yamashita, Air Conditioner, Aug. 2, 2012, WO2012101676A1, Whole Document.*

Office Action dated Oct. 21, 2014 issued in corresponding JP patent application No. 2013-520324 (and English translation).

International Search Report of the International Searching Authority dated Sep. 13, 2011 for the corresponding international application No. PCT/JP2011/003442.

Office Action dated Jan. 19, 2015 issued in corresponding CN patent application No. 201180071152.5 (and English translation).

Extended European Search Report dated Oct. 2, 2014 issued in corresponding EP patent application No. 11867937.2.

* cited by examiner (a)

FIG. 8

EFFECT OF SET REFRIGERANT COMPOSITION ON CALCULATED REFRIGERANT COMPOSITION

| SET CIRCULATION COMPOSITION $\alpha b$ [wt%] | CALCULATED CIRCULATION COMPOSITION $\alpha$ [wt%] |
|---|---|
| 50 | 62.48 |
| 54 | 62.52 |
| 58 | 62.56 |
| 62 | 62.60 |
| 66 | 62.63 |
| 70 | 62.65 |
| 74 | 62.68 |

FIG. 9

CALCULATED R32 COMPOSITION

| No. | TH1 [°C] | P1 [MPa abs] | TH2 [°C] | $\alpha$ (TABLE) [wt%] | $\alpha$ (DETAILED VERSION) [wt%] |
|---|---|---|---|---|---|
| 1 | 44.0 | 0.6 | -3.0 | 37.34 | 37.40 |
| 2 | 45.0 | 0.6 | -3.0 | 37.21 | 37.27 |
| 3 | 43.0 | 0.6 | -3.0 | 37.47 | 37.53 |
| 4 | 44.0 | 0.6 | -2.0 | 42.05 | 42.15 |
| 5 | 44.0 | 0.6 | -4.0 | 32.64 | 32.67 |
| 6 | 44.0 | 0.65 | -3.0 | 24.27 | 24.24 |
| 7 | 44.0 | 0.55 | -3.0 | 47.82 | 47.95 |

AIR-CONDITIONING APPARATUS

CROSS REFERENCE TO RELATED APPLICATION

This application is a U.S. national stage application of PCT/JP2011/003442 filed on Jun. 16, 2011, the disclosure of which is incorporated by reference.

TECHNICAL FIELD

The present invention relates to an air-conditioning apparatus applied, for example, to multi-air-conditioning apparatuses for buildings.

BACKGROUND

Air-conditioning apparatuses include one in which, like a multi-air-conditioning apparatus for buildings, a heat source (outdoor unit) is installed outside a building and an indoor unit is installed inside the building. A refrigerant that circulates in a refrigerant circuit of the air-conditioning apparatus transfers heat to (or receives heat from) air supplied to a heat exchanger of the indoor unit so as to heat or cool the air. Then, the heated or cooled air is sent to an air-conditioned space for heating or cooling the space.

Such an air-conditioning apparatus often includes a plurality of indoor units, because a building typically has a plurality of indoor spaces. In the case of a large building, a refrigerant pipe that connects the outdoor unit and each indoor unit may reach as long as 100 m. The longer the pipe that connects the outdoor unit and the indoor unit, the larger the amount of refrigerant charged into the refrigerant circuit.

An indoor unit of such a multi-air-conditioning apparatus for buildings is typically installed and used in an indoor space (e.g., office space, room, or shop) where there are people. If for some reason a refrigerant leaks from the indoor unit installed in the indoor space, since the refrigerant may be flammable or toxic depending on its type, the leakage may cause safety or health problems. Even if the refrigerant is harmless to the human body, the leakage of the refrigerant may lower the concentration of oxygen in the indoor space and negatively affect the human body.

As a solution to this, an air-conditioning apparatus may use a secondary loop method in which, for air-conditioning of a space where there are people, a primary-side loop is performed with a refrigerant and a secondary-side loop is performed with harmless water or brine.

For prevention of global warming, there has been a demand for development of air-conditioning apparatuses that use a refrigerant with a low global warming potential (hereinafter may also be referred to as GWP). Promising low GWP refrigerants include R32, HFO1234yf, and HFO1234ze. Adopting only R32 as a refrigerant does not involve significant design changes to the current apparatus and requires only a small development load, because R32 has substantially the same physical properties as R410A which is currently most often used. However, R32 has a GWP of 675, which is a little high. On the other hand, if HFO1234yf or HFO1234ze alone is adopted as a refrigerant, the pressure of the refrigerant is low because of its small density in a low-pressure state (gas state or two-phase gas-liquid state), and thus the loss of pressure increases. However, increasing the diameter (inside diameter) of a refrigerant pipe to reduce the loss of pressure leads to a higher cost.

By using a mixture of R32 and HFO1234yf or HFO1234ze as a refrigerant, it is possible to reduce the GWP while increasing the pressure of the refrigerant. Since R32, HFO1234yf, and HFO1234ze have different boiling points, the resulting refrigerant mixture is a non-azeotropic refrigerant mixture.

It is known that in an air-conditioning apparatus using a non-azeotropic refrigerant mixture, the composition of the refrigerant charged in the apparatus is different from the composition of the refrigerant actually circulating in the refrigeration cycle. This is because the boiling points of the mixed refrigerants are different as described above. The change in refrigerant composition during circulation causes the degree of superheat or subcooling to deviate from the original value, makes it difficult to optimally control the opening degree of an expansion device and various other devices, and leads to degraded performance of the air-conditioning apparatus. To reduce such performance degradation, various refrigerating and air-conditioning apparatuses with means for detecting a refrigerant composition have been proposed (see, e.g., Patent Literatures 1 and 2).

The technique described in Patent Literature 1 includes a bypass that is connected to bypass a compressor, and a double-pipe heat exchanger and a capillary tube are connected to the bypass. A refrigerant composition is calculated on the basis of detection results of various detecting means included in the bypass and a refrigerant composition tentatively set. To determine the refrigerant composition, the technique described in Patent Literature 1 performs repetitive calculations until the calculated refrigerant composition satisfies a condition specified in a control flow.

Like the technique described in Patent Literature 1, the technique described in Patent Literature 2 involves setting a tentative refrigerant composition and calculating a refrigerant composition by repetitive calculations. The technique described in Patent Literature 2 includes a calculation flow for eliminating repetitive calculations.

PATENT LITERATURE

Patent Literature 1: Japanese Unexamined Patent Application Publication No. 8-75280 (see, e.g., FIG. 8)

Patent Literature 2: Japanese Unexamined Patent Application Publication No. 11-63747 (see, e.g., FIGS. 5 and 9)

In the techniques described in Patent Literatures 1 and 2, where a refrigerant composition is calculated by repetitive calculations, a controller undergoes a heavy calculation load. Also, since the techniques described in Patent Literatures 1 and 2 involve dealing with a large amount of physical property data for the repetitive calculations, a read only memory (ROM) of the controller undergoes a substantial load.

The technique described in Patent Literature 2 has a calculation flow for eliminating the repetitive calculations. However, since some calculations are omitted in the calculation flow, the accuracy of detecting a refrigerant composition may be degraded.

SUMMARY

An object of the present invention is to provide an air-conditioning apparatus that can calculate a refrigerant composition with high accuracy while reducing a calculation load on a controller (computing device) and a load on a ROM.

An air-conditioning apparatus according to the present invention is one that includes a compressor, a first heat exchanger, an expansion device, and a second heat exchanger that are connected by a refrigerant pipe to form a refrigeration cycle, and uses a non-azeotropic refrigerant mixture as a refrigerant for the refrigeration cycle. The air-conditioning apparatus includes a bypass connected to bypass the compressor; a bypass heat exchanger included in the bypass and configured to cool the refrigerant flowing from the compressor into the bypass; a second expansion device included in the bypass and configured to reduce a pressure of the refrigerant flowing out of the bypass heat exchanger; refrigerant state detecting means for detecting a temperature of the refrigerant flowing into the second expansion device, a temperature of the refrigerant flowing out of the second expansion device, and a pressure of the refrigerant sucked into the compressor; and a computing device configured to calculate a composition of the refrigerant circulating in the refrigeration cycle on the basis of a detection result of the refrigerant state detecting means. The computing device calculates a quality of the refrigerant flowing out of the second expansion device on the basis of an inlet liquid enthalpy calculated on the basis of the temperature of the refrigerant flowing into the second expansion device and a saturated gas enthalpy and a saturated liquid enthalpy calculated on the basis of the temperature of the refrigerant flowing out of the second expansion device or the pressure of the refrigerant sucked into the compressor; calculates a liquid-phase concentration and a gas-phase concentration of the refrigerant flowing out of the second expansion device on the basis of the temperature of the refrigerant flowing out of the second expansion device and the pressure of the refrigerant sucked into the compressor; and calculates the composition of the refrigerant circulating in the refrigeration cycle on the basis of the calculated quality, liquid-phase concentration, and gas-phase concentration.

In the air-conditioning apparatus according to the present invention, the computing device calculates a quality of the refrigerant flowing out of the second expansion device on the basis of an inlet liquid enthalpy calculated on the basis of the temperature of the refrigerant flowing into the second expansion device and a saturated gas enthalpy and a saturated liquid enthalpy calculated on the basis of the temperature of the refrigerant flowing out of the second expansion device or the pressure of the refrigerant sucked into the compressor; calculates a liquid-phase concentration and a gas-phase concentration of the refrigerant flowing out of the second expansion device on the basis of the temperature of the refrigerant flowing out of the second expansion device and the pressure of the refrigerant sucked into the compressor; and calculates the composition of the refrigerant circulating in the refrigeration cycle on the basis of the calculated quality, liquid-phase concentration, and gas-phase concentration. It is thus possible to calculate a refrigerant composition with high accuracy while reducing a calculation load on a controller (computing device) and a load on a ROM.

BRIEF DESCRIPTION OF DRAWINGS

FIG. 8 is a table for describing to what extent a refrigerant composition set in the control flow for calculating a refrigerant composition gives an error to a calculated refrigerant composition.

FIG. 9 is a table for describing to what extent various detection results in the control flow for calculating a refrigerant composition give an error to a calculated refrigerant composition.

DETAILED DESCRIPTION

Embodiment of the present invention will now be described with reference to the drawings.

Embodiment

Figure 1:
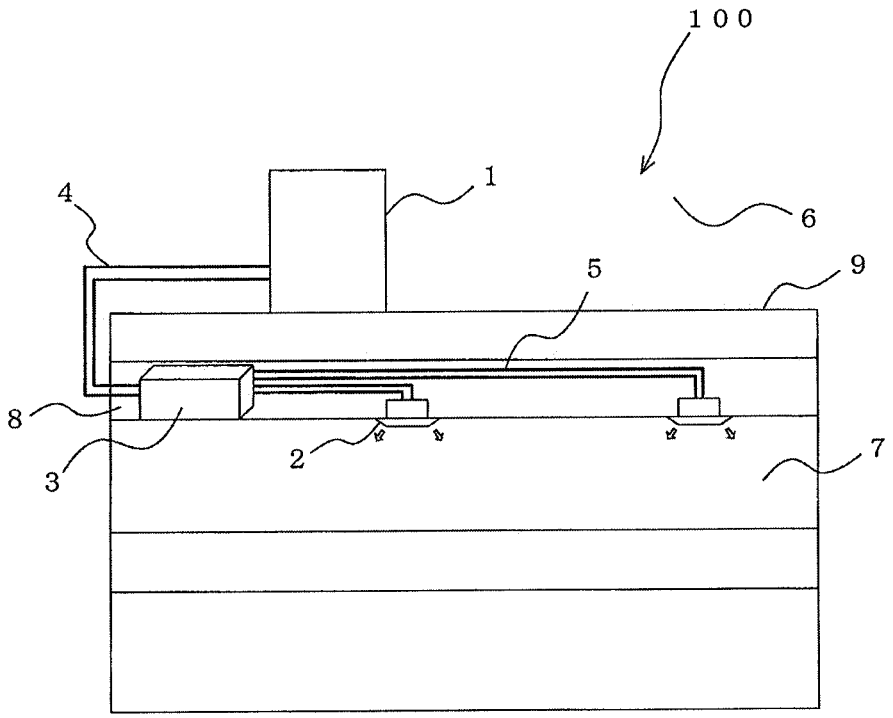
FIG. 1 is a schematic view illustrating an example of installation of an air-conditioning apparatus according to Embodiment of the present invention.

FIG. 1 is a schematic view illustrating an example of installation of an air-conditioning apparatus 100 according to Embodiment of the present invention. The example of installation of the air-conditioning apparatus 100 will be described with reference to FIG. 1. The air-conditioning apparatus 100 includes a refrigeration cycle for circulating a refrigerant. Each of indoor units 2*a* to 2*d* can freely select a cooling mode or a heating mode as an operation mode.

The air-conditioning apparatus 100 according to Embodiment includes a refrigerant circuit A (see FIG. 2) which uses a non-azeotropic refrigerant mixture as a refrigerant, and a heat medium circuit B which uses water or the like as a heat medium. The air-conditioning apparatus 100 has an improved feature that calculates, with high accuracy, a composition of the refrigerant that circulates in the refrigerant circuit A.

In Embodiment, a non-azeotropic refrigerant mixture composed of R32 and HFO1234yf is used. A low-boiling refrigerant is R32 and a high-boiling refrigerant is HFO1234yf. Unless otherwise specified, a refrigerant composition in Embodiment refers to a composition of R32 which is a low-boiling refrigerant that circulates in the refrigeration cycle. A refrigerant composition of HFO1234yf, which is a high-boiling refrigerant, will not be described, as it is uniquely determined by determining the refrigerant composition of R32.

The air-conditioning apparatus 100 according to Embodiment adopts a method (indirect method) that indirectly uses a refrigerant (heat-source-side refrigerant). Specifically, the air-conditioning apparatus 100 transfers cooling energy or heating energy stored in the heat-source-side refrigerant to a refrigerant (hereinafter referred to as a heat medium) different from the heat-source-side refrigerant, and thereby cools or heats an air-conditioned space with the cooling energy or heating energy stored in the heat medium.

As illustrated in FIG. 1, the air-conditioning apparatus 100 according to Embodiment includes one outdoor unit 1 serving as a heat source device, a plurality of indoor units 2, and a heat medium relay unit 3 disposed between the outdoor unit 1 and the indoor units 2. The heat medium relay unit 3 allows heat exchange between the heat-source-side refrigerant and the heat medium. The outdoor unit 1 and the heat medium relay unit 3 are connected to each other by refrigerant pipes 4 for circulating the heat-source-side refrigerant. The heat medium relay unit 3 and each of the indoor units 2 are connected to each other by pipes (heat medium pipes) 5 for circulating the heat medium. Cooling energy or heating energy generated by the outdoor unit 1 is delivered via the heat medium relay unit 3 to the indoor units 2.

The outdoor unit 1 is typically placed in an outdoor space 6 which is a space (e.g., rooftop) outside a building 9. The outdoor unit 1 supplies cooling energy or heating energy via the heat medium relay unit 3 to the indoor units 2.

The indoor units 2 are each placed at a location from which cooling air or heating air can be supplied to an indoor space 7 which is a space (e.g., room) inside the building 9. The indoor units 2 supply cooling air or heating air to the indoor space 7 which is to be an air-conditioned space.

The heat medium relay unit 3 is installed in a housing separate from those for the outdoor unit 1 and the indoor units 2, and is placed at a location different from the outdoor space 6 and the indoor space 7. The heat medium relay unit 3 is connected via the refrigerant pipes 4 to the outdoor unit 1, and connected via the pipes 5 to the indoor units 2. The heat medium relay unit 3 transfers, to the indoor units 2, cooling energy or heating energy supplied from the outdoor unit 1.

As illustrated in FIG. 1, in the air-conditioning apparatus 100 according to Embodiment, the outdoor unit 1 and the heat medium relay unit 3 are connected via two refrigerant pipes 4, and the heat medium relay unit 3 and each of the indoor units 2*a* to 2*d* are connected via two pipes 5. Thus, connecting the different units (outdoor unit 1, indoor units 2, and heat medium relay unit 3) via the refrigerant pipes 4 and the pipes 5 facilitates construction of the air-conditioning apparatus 100 according to Embodiment.

FIG. 1 illustrates an example where the heat medium relay unit 3 is installed in a space inside the building 9 but not in the indoor space 7. Specifically, in FIG. 1, the heat medium relay unit 3 is installed in a space above a ceiling (e.g., a space above the ceiling in the building 9, hereinafter simply referred to as a space 8). The heat medium relay unit 3 may be installed in a shared space, such as a space where there is an elevator. Although the indoor units 2 are of a ceiling cassette type in FIG. 1, the type of the indoor units 2 is not limited to this. That is, the air-conditioning apparatus 100 may be of a ceiling concealed type, a hanging type, or any other type, as long as heating air or cooling air can be blown either directly or through ducts to the indoor space 7.

Although the outdoor unit 1 is installed in the outdoor space 6 in FIG. 1, the location of installation is not limited to this. For example, the outdoor unit 1 may be installed in a confined space, such as a machine room with ventilation openings, or may be installed inside the building 9 as long as waste heat can be discharged through an exhaust duct to the outside of the building 9. Even when the outdoor unit 1 is a water-cooled unit, the outdoor unit 1 can be installed inside the building 9. Installing the outdoor unit 1 in such a location causes no particular problems.

The heat medium relay unit 3 may be installed near the outdoor unit 1. However, it should be noted that if the distance from the heat medium relay unit 3 to the indoor units 2 is too long, the energy-saving effect will be reduced, because a very large amount of power is required to convey the heat medium. The number of different types of units (the outdoor unit 1, the indoor units 2, and the heat medium relay unit 3) connected to each other is not limited to that illustrated in FIG. 1, and may be determined, for example, depending on the building 9 where the air-conditioning apparatus 100 is installed.

Figure 2:
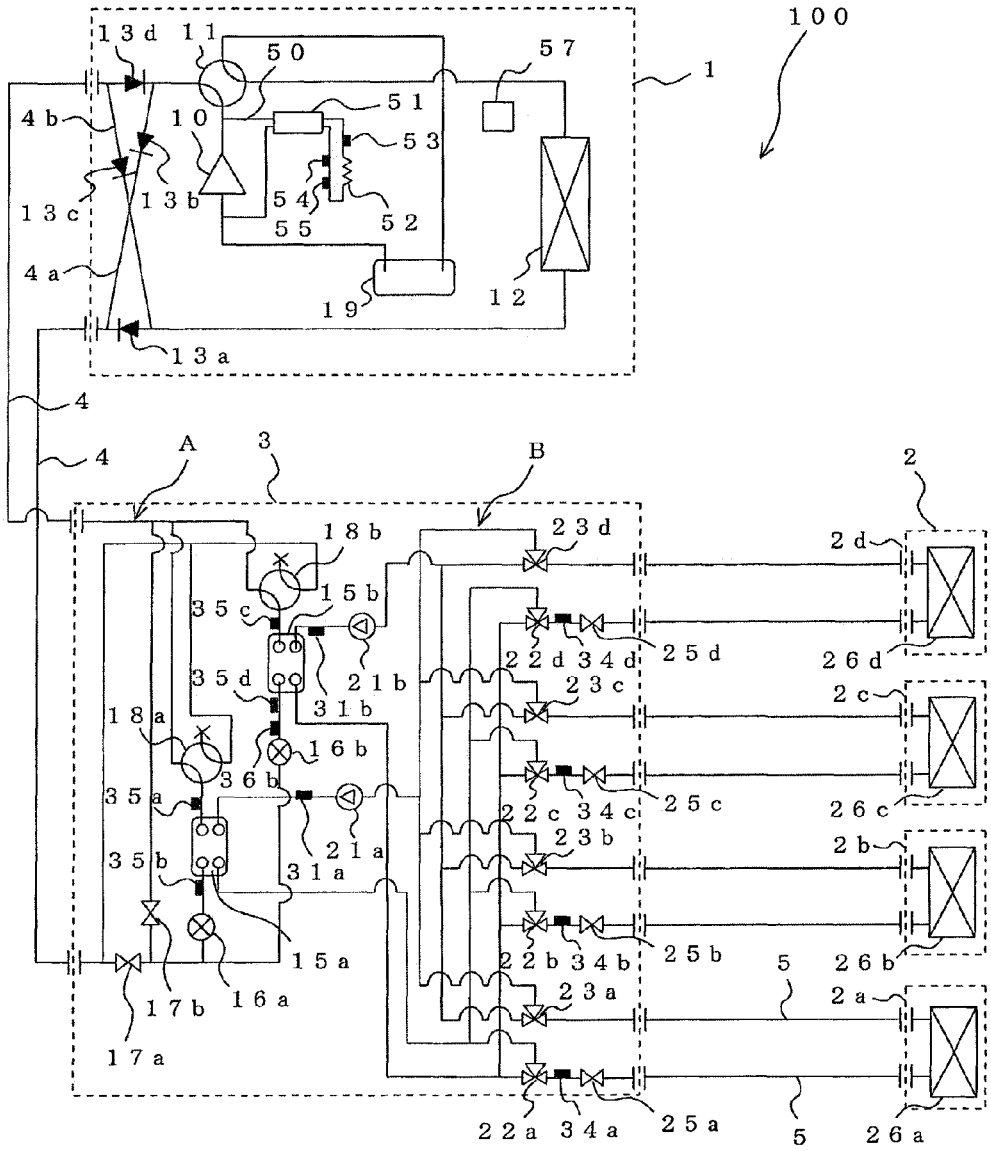
FIG. 2 illustrates a configuration of a refrigerant circuit of the air-conditioning apparatus according to Embodiment of the present invention.
Figure 3:
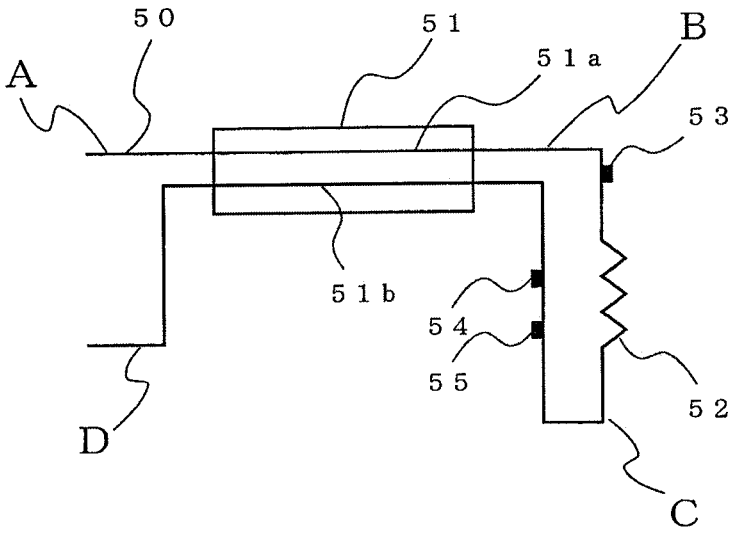
FIG. 3 is an enlarged view of a bypass (composition detecting circuit) of the air-conditioning apparatus illustrated in FIG. 2.
Figure 4:
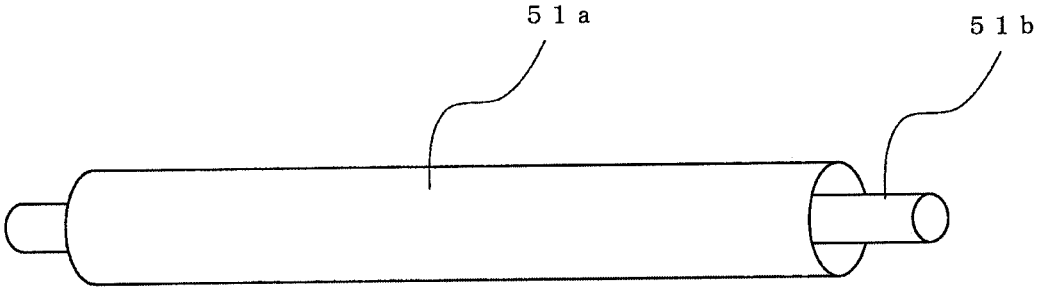
FIG. 4 is a schematic view of a heat exchanging device illustrated in FIG. 3.

FIG. 2 illustrates a configuration of a refrigerant circuit of the air-conditioning apparatus 100 according to Embodiment of the present invention. FIG. 3 is an enlarged view of a bypass 50 (composition detecting circuit) of the air-conditioning apparatus 100 illustrated in FIG. 2. FIG. 4 is a schematic view of a heat exchanging device 51 illustrated in FIG. 3. A configuration of the air-conditioning apparatus 100 will be described in detail with reference to FIGS. 2 to 4.

As illustrated in FIG. 2, the outdoor unit 1 and the heat medium relay unit 3 are connected to each other by the refrigerant pipes 4 via an intermediate heat exchanger 15*a* and an intermediate heat exchanger 15*b* included in the heat medium relay unit 3. The heat medium relay unit 3 and the indoor units 2 are connected to each other by the pipes 5 also via the intermediate heat exchanger 15*a* and the intermediate heat exchanger 15*b*. The refrigerant pipes 4 will be described in detail later on.

[Outdoor Unit 1]

The outdoor unit 1 includes a compressor 10 that compresses the refrigerant, a first refrigerant flow switching device 11 formed by a four-way valve or the like, a heat-source-side heat exchanger 12 serving as an evaporator or a condenser, and an accumulator 19 that stores an excess refrigerant. These components of the outdoor unit 1 are connected to the refrigerant pipes 4.

The outdoor unit 1 is provided with a first connecting pipe 4*a*, a second connecting pipe 4*b*, a check valve 13*a*, a check valve 13*b*, a check valve 13*c*, and a check valve 13*d*. With the first connecting pipe 4*a*, the second connecting pipe 4*b*, the check valve 13*a*, the check valve 13*b*, the check valve 13*c*, and the check valve 13*d*, the flow of the heat-source-side refrigerant into the heat medium relay unit 3 can be regulated in a given direction, regardless of the operation requested by any indoor unit 2.

As illustrated in FIGS. 2 and 3, the outdoor unit 1 includes the bypass 50 for detecting (calculating) a refrigerant composition. The bypass 50 includes the heat exchanging device 51 for heat exchange between the refrigerant flowing thereinto from a discharge side of the compressor 10 and the refrigerant flowing into a suction side of the compressor 10, and an expansion device 52 for reducing a pressure of the refrigerant flowing into the bypass 50. The bypass 50 includes an inlet temperature sensor 53 that detects a temperature of the refrigerant before it flows into the expansion device 52, an outlet temperature sensor 54 that detects a temperature of the refrigerant flowing out of the expansion device 52, and an outlet pressure sensor 55 that detects a pressure of the refrigerant flowing out of the expansion device 52.

As illustrated in FIG. 2, the outdoor unit 1 further includes a computing device 57 that calculates a refrigerant composition on the basis of the detection results of the inlet temperature sensor 53, the outlet temperature sensor 54, and the outlet pressure sensor 55.

The compressor 10 sucks in the heat-source-side refrigerant, and compresses the heat-source-side refrigerant into a high-temperature high-pressure state. For example, the compressor 10 may be formed by a capacity-controllable inverter compressor.

The first refrigerant flow switching device 11 switches the flow of the heat-source-side refrigerant between a heating operation mode (a heating only operation mode and a heating main operation mode) and a cooling operation mode (a cooling only operation mode and a cooling main operation mode).

The heat-source-side heat exchanger 12 serves as an evaporator during heating operation, serves as a radiator (gas cooler) during cooling operation, and allows heat exchange between air supplied from an air-sending device such as a fan (not shown) and the heat-source-side refrigerant.

The accumulator 19 is disposed on the suction side of the compressor 10. The accumulator 19 stores an excess refrigerant produced by a difference between the heating operation mode and the cooling operation mode, and an excess refrigerant produced by a transitional change in operation (e.g., a change in the number of the indoor units 2 in operation) or produced depending on the load condition. In the accumulator 19, the refrigerant is separated into a liquid-phase refrigerant containing more high-boiling refrigerant and a gas-phase refrigerant containing more low-boiling refrigerant. The liquid-phase refrigerant containing more high-boiling refrigerant is stored in the accumulator 19. Therefore, when there is a liquid-phase refrigerant in the accumulator 19, more low-boiling refrigerant tends to be contained in the composition of the refrigerant circulating in the air-conditioning apparatus 100.

[Refrigerant Composition Detecting Mechanism]

The heat exchanging device 51 (bypass heat exchanger) allows heat exchange between the refrigerant discharged from the compressor 10 and flowing into the bypass 50, and the refrigerant flowing out of the expansion device 52 and pressure-reduced. That is, the heat exchanging device 51 cools the high-pressure high-temperature refrigerant discharged from the compressor 10 and the flowing into the bypass 50 and turns it into a two-phase gas-liquid refrigerant. For example, the heat exchanging device 51 may use a double-pipe method. Here, the double-pipe method refers to a configuration where, as illustrated in FIG. 4, a low-pressure two-phase refrigerant flowing out of the expansion device 52 passes through an inside pipe 51*b* and a high-temperature gas refrigerant flowing into from the discharge side of the compressor 10 passes through an outside pipe (annular part) 51*a*. This can reduce the cost of the heat exchanging device 51. Note that the heat exchanging device 51 is not limited to this. The heat exchanging device 51 may have a configuration where the pipe 51*a* and the pipe 51*b* are in contact. A plate heat exchanger, which is expensive, may be used as the heat exchanging device 51.

The expansion device 52 (second expansion device) reduces the pressure of the refrigerant flowing out of the heat exchanging device 51 and turns it into a low-pressure two-phase gas-liquid refrigerant. The expansion device 52 is connected at one end thereof to the pipe 51*a* of the heat exchanging device 51, and connected at the other end thereof to the pipe 51*b* of the heat exchanging device 51. The expansion device 52 may be formed by a device having a variably controllable opening degree, such as an electronic expansion valve.

The inlet temperature sensor 53 (forming a refrigerant state detecting means) detects a temperature of the refrigerant before it flows into the expansion device 52. For example, the inlet temperature sensor 53 may be provided in a pipe that connects the pipe 51*a* of the heat exchanging device 51 and the expansion device 52.

The outlet temperature sensor 54 (forming the refrigerant state detecting means) detects a temperature of the refrigerant flowing out of the expansion device 52. For example, the outlet temperature sensor 54 may be provided in a pipe that connects the expansion device 52 and the pipe 51*b* of the heat exchanging device 51. The inlet temperature sensor 53 and the outlet temperature sensor 54 are connected to the computing device 57 that controls the overall operation of various devices.

The outlet pressure sensor 55 (forming the refrigerant state detecting means) detects a pressure of the refrigerant flowing out of the expansion device 52. The outlet pressure sensor 55 is described as being provided, for example, in the pipe that connects the expansion device 52 and the pipe 51*b* of the heat exchanging device 51, but the location of the outlet pressure sensor 55 is not limited to this. That is, the outlet pressure sensor 55 may be provided in a pipe extending from a refrigerant discharge side of the expansion device 52 to the suction side of the compressor 10, or may be provided in a pipe located downstream of the compressor 10. That is, the outlet pressure sensor 55 may be provided at any location, as long as it can detect a low-pressure refrigerant sucked into the compressor 10. The pipe located downstream of the compressor 10 refers to, for example, a pipe that connects the first refrigerant flow switching device 11 and the accumulator 19. The outlet pressure sensor 55 is connected to the computing device 57 that controls the overall operation of various devices.

The computing device 57 calculates a refrigerant composition on the basis of the detection results of the inlet temperature sensor 53, the outlet temperature sensor 54, and the outlet pressure sensor 55. The computing device 57 is connected not only to the inlet temperature sensor 53, the outlet temperature sensor 54, and the outlet pressure sensor 55, but also to a controller (not shown) that controls the overall operation of various devices described below. Thus, on the basis of the refrigerant composition calculated by the computing device 57, the controller can optimally control, for example, the opening degree of the expansion device 16 described below.

FIG. 2 illustrates an example where the computing device 57 is installed in the outdoor unit 1 which includes the inlet temperature sensor 53, the outlet temperature sensor 54, and the outlet pressure sensor 55. However, the location of the computing device 57 is not limited to this. The computing device 57 may be installed in each indoor unit 2 or in the heat medium relay unit 3.

In the computing device 57, a ROM stores a physical property table that shows, for each refrigerant composition value, a correlation between a liquid enthalpy and a refrigerant temperature, a correlation between a saturated liquid enthalpy and a refrigerant temperature, and a correlation between a saturated gas enthalpy and a refrigerant temperature. Also in the computing device 57, the ROM stores a physical property table that shows, for each refrigerant pressure, a correlation between a saturated liquid temperature of a refrigerant and a liquid refrigerant concentration, and a correlation between a saturated gas temperature of a refrigerant and a gas refrigerant concentration (see FIGS. 7(*a*) and 7(*b*)). The physical property tables in the computing device 57 can be set, for example, after installation of the air-conditioning apparatus 100. Although the physical property tables showing the above-described correlations have been described as being stored in the ROM of the computing device 57, formulated functions instead of tables may be stored in the ROM.

Various physical quantities calculated by the computing device 57 will now be described.

The computing device 57 can calculate a liquid enthalpy (inlet liquid enthalpy) of the refrigerant flowing into the expansion device 52 on the basis of a physical property table and a detection result of the inlet temperature sensor 53. On the basis of the physical property table and a detection result of the outlet temperature sensor 54, the computing device 57 calculates a saturated liquid enthalpy and a saturated gas enthalpy of the refrigerant flowing out of the expansion device 52.

Although an exact refrigerant composition value is not yet known when the computing device 57 calculates the inlet liquid enthalpy, saturated liquid enthalpy, and saturated gas enthalpy, the computing device 57 sets a tentative refrigerant composition value and calculates them. That is, the computing device 57 calculates the liquid enthalpy on the basis of a physical property table corresponding to the set refrigerant composition value and the detection result of the inlet temperature sensor 53, and calculates the saturated liquid enthalpy and the saturated gas enthalpy on the basis of the physical property table and the detection result of the outlet temperature sensor 54. Thus, even when an exact refrigerant composition value is not yet known, the air-conditioning apparatus 100 according to Embodiment can calculate a refrigerant composition with high accuracy, and eliminate the need for repetitive calculations required in the related art. This will be described later on.

On the basis of the physical property table and the detection results of the outlet temperature sensor 54 and the outlet pressure sensor 55, the computing device 57 can further calculate a concentration of the liquid refrigerant flowing out of the expansion device 52 and a concentration of the gas refrigerant flowing out of the expansion device 52.

The computing device 57 can calculate a quality on the basis of the calculated inlet liquid enthalpy, saturated liquid enthalpy, and saturated gas enthalpy. The quality is calculated using the following Equation 1:

$$Xr = \frac{Hin - Hls}{Hgs - Hls} \quad \text{[Equation 1]}$$

The computing device 57 calculates a refrigerant composition on the basis of the quality, the concentration of liquid refrigerant, and the concentration of gas refrigerant. The refrigerant composition is calculated using the following Equation 2:

$$\alpha=(1-Xr)\times XR32+Xr\times YR32 \quad \text{[Equation 2]}$$

[Indoor Units 2]

Each of the indoor units 2 includes a use-side heat exchanger 26. The use-side heat exchanger 26 is connected by the pipes 5 to the corresponding heat medium flow control device 25 and the corresponding second heat medium flow switching device 23 of the heat medium relay unit 3. The use-side heat exchanger 26 allows heat exchange between air supplied from an air-sending device such as a fan (not shown) and the heat medium, and generates heating air or cooling air to be supplied to the indoor space 7.

[Heat Medium Relay Unit 3]

The heat medium relay unit 3 includes two intermediate heat exchangers 15 for heat exchange between the refrigerant and the heat medium, two expansion devices 16*a* and 16*b* for reducing the pressure of the refrigerant, two opening and closing devices 17*a* and 17*b* for opening and closing the passages of the refrigerant pipes 4, two second refrigerant flow switching devices 18 for switching the refrigerant passages, two pumps 21 for circulating the heat medium, four first heat medium flow switching devices 22 connected to the respective pipes 5, four second heat medium flow switching devices 23 connected to the other respective pipes 5, and four heat medium flow control devices 25 connected to the respective pipes 5 to which the first heat medium flow switching devices 22 are connected.

The two intermediate heat exchangers 15*a* and 15*b* (also referred to as the intermediate heat exchangers 15) each serve as a condenser (radiator) or an evaporator, allow heat exchange between the heat-source-side refrigerant and the heat medium, and transfer cooling energy or heating energy generated by the outdoor unit 1 and stored in the heat-source-side refrigerant to the heat medium. The intermediate heat exchanger 15*a* is disposed between the expansion device 16*a* and a second refrigerant flow switching device 18*a* in the refrigerant circuit A, and used for cooling the heat medium in a cooling and heating mixed operation mode. The intermediate heat exchanger 15*b* is disposed between the expansion device 16*b* and a second refrigerant flow switching device 18*b* in the refrigerant circuit A, and used for heating the heat medium in the cooling and heating mixed operation mode.

The two expansion devices 16*a* and 16*b* (which may also be referred to as the expansion devices 16) each serve as a pressure reducing valve or an expansion valve, and reduce the pressure of the heat-source-side refrigerant and expand it. The expansion device 16*a* is disposed upstream of the intermediate heat exchanger 15*a* in the direction in which the heat-source-side refrigerant flows in the cooling only operation mode. The expansion device 16*b* is disposed upstream of the intermediate heat exchanger 15*b* in the direction in which the heat-source-side refrigerant flows in the cooling only operation mode. The two expansion devices 16 may each be formed by a device having a variably controllable opening degree, such as an electronic expansion valve.

The opening and closing devices 17*a* and 17*b* are each formed by a two-way valve or the like, and open and close the corresponding refrigerant pipe 4.

The two second refrigerant flow switching devices 18*a* and 18*b* (which may also be referred to as the second refrigerant flow switching devices 18) are each formed by a four-way valve or the like, and switch the flow of the heat-source-side refrigerant depending on the operation mode. The second refrigerant flow switching device 18*a* is disposed downstream of the intermediate heat exchanger 15*a* in the direction in which the heat-source-side refrigerant flows in the cooling only operation mode. The second refrigerant flow switching device 18*b* is disposed downstream of the intermediate heat exchanger 15*b* in the direction in which the heat-source-side refrigerant flows in the cooling only operation mode.

Two pumps 21*a* and 21*b* (which may also be referred to as the pumps 21) circulate the heat medium in the pipes 5. The pump 21*a* is provided in the pipe 5 between the intermediate heat exchanger 15*a* and the corresponding second heat medium flow switching device 23. The pump 21*b* is provided in the pipe 5 between the intermediate heat exchanger 15*b* and the corresponding second heat medium flow switching device 23. The two pumps 21 may be formed, for example, by capacity-controllable pumps. The pump 21*a* may be provided in the pipe 5 between the intermediate heat exchanger 15*a* and the corresponding first heat medium flow switching device 22. The pump 21*b* may be provided in the pipe 5 between the intermediate heat exchanger 15*b* and the corresponding first heat medium flow switching device 22.

Four first heat medium flow switching devices 22*a* to 22*d* (which may also be referred to as the first heat medium flow switching devices 22) are each formed by a three-way valve or the like, and switch the passage of the heat medium. The number of the first heat medium flow switching devices 22 is determined in accordance with the number of the indoor units 2 installed (which is four here). Each of the first heat medium flow switching devices 22 is connected at one of the three ports thereof to the intermediate heat exchanger 15*a*, connected at another of the three ports thereof to the intermediate heat exchanger 15*b*, and connected at the remaining one of the three ports thereof to the corresponding heat medium flow control device 25. The first heat medium flow switching devices 22 are each located on the outlet side of the heat medium passage of the corresponding use-side heat exchanger 26. In the drawing, the first heat medium flow switching device 22*a*, the first heat medium flow switching device 22*b*, the first heat medium flow switching device 22*c*, and the first heat medium flow switching device 22*d* are illustrated, in this order from the bottom of the drawing, to correspond to the respective indoor units 2.

Four second heat medium flow switching devices 23*a* to 23*d* (which may also be referred to as the second heat medium flow switching devices 23) are each formed by a three-way valve or the like, and switch the passage of the heat medium. The number of the second heat medium flow switching devices 23 is determined in accordance with the number of the indoor units 2 installed (which is four here). Each of the second heat medium flow switching devices 23 is connected at one of the three ports thereof to the intermediate heat exchanger 15*a*, connected at another of the three ports thereof to the intermediate heat exchanger 15*b*, and connected at the remaining one of the three ports thereof to the corresponding use-side heat exchanger 26. The second heat medium flow switching devices 23 are each located on the inlet side of the heat medium passage of the corresponding use-side heat exchanger 26. In the drawing, the second heat medium flow switching device 23*a*, the second heat medium flow switching device 23*b*, the second heat medium flow switching device 23*c*, and the second heat medium flow switching device 23*d* are illustrated, in this order from the bottom of the drawing, to correspond to the respective indoor units 2.

Four heat medium flow control devices 25*a* to 25*d* (which may also be referred to as the heat medium flow control devices 25) are each formed, for example, by a two-way valve capable of controlling the opening area thereof, and control the flow rate of the heat medium flowing in the corresponding pipe 5. The number of the heat medium flow control devices 25 is determined in accordance with the number of the indoor units 2 installed (which is four here). Each of the heat medium flow control devices 25 is connected at one end thereof to the corresponding use-side heat exchanger 26, and connected at the other end thereof to the corresponding first heat medium flow switching device 22. The heat medium flow control devices 25 are each located on the outlet side of the heat medium passage of the corresponding use-side heat exchanger 26. In the drawing, the heat medium flow control device 25*a*, the heat medium flow control device 25*b*, the heat medium flow control device 25*c*, and the heat medium flow control device 25*d* are illustrated, in this order from the bottom of the drawing, to correspond to the respective indoor units 2. The heat medium flow control devices 25 may each be located on the inlet side of the heat medium passage of the corresponding use-side heat exchanger 26.

The heat medium relay unit 3 includes various detecting means (two first temperature sensors 31*a* and 31*b*, four second temperature sensors 34*a* to 34*d*, four third temperature sensors 35*a* to 35*d*, and a pressure sensor 36). Information detected by these detecting means (e.g., temperature information, pressure information, and concentration information of the heat-source-side refrigerant) is sent to a controller that controls the overall operation of the air-conditioning apparatus 100, and used to control the driving frequency of the compressor 10, the rotation speeds of the air-sending devices (not shown) near the heat-source-side heat exchanger 12 and the use-side heat exchangers 26, the switching of the first refrigerant flow switching device 11, the driving frequencies of the pumps 21, the switching of the second refrigerant flow switching devices 18, and the switching of the heat medium passages.

The controller (not shown) is formed, for example, by a microcomputer. On the basis of the refrigerant composition calculated by the computing device 57, the controller calculates an evaporation temperature, a condensing temperature, a saturation temperature, a degree of superheat, and a degree of subcooling. On the basis of these calculations, the controller controls the opening degrees of the expansion devices 16, the rotation speed of the compressor 10, and the speeds (including ON/OFF) of the fans for the heat-source-side heat exchanger 12 and the use-side heat exchangers 26, so as to maximize the performance of the air-conditioning apparatus 100.

Besides, on the basis of detection information from the various detecting means and instructions from a remote control, the controller controls the driving frequency of the compressor 10, the speeds (including ON/OFF) of the air-sending devices, the switching of the first refrigerant flow switching device 11, the drive of the pumps 21, the opening degrees of the expansion devices 16, the opening and closing of the opening and closing devices 17, the switching of the second refrigerant flow switching devices 18, the switching of the first heat medium flow switching devices 22, the switching of the second heat medium flow switching devices 23, and the opening degrees of the heat medium flow control devices 25. That is, the controller controls the overall operation of various devices to execute each operation mode described below. The controller may be provided in each indoor unit 2, or may be provided in the heat medium relay unit 3. Although the controller and the computing device 57 have been described as separate units, they may be formed as a single unit.

The two first temperature sensors 31*a* and 31*b* (which may also be referred to as the first temperature sensors 31)

each detect the temperature of the heat medium flowing out of the corresponding intermediate heat exchanger 15, that is, the temperature of the heat medium at the outlet of the intermediate heat exchanger 15. The first temperature sensors 31*a* and 31*b* may each be formed, for example, by a thermistor. The first temperature sensor 31*a* is provided in the pipe 5 on the inlet side of the pump 21*a*. The first temperature sensor 31*b* is provided in the pipe 5 on the inlet side of the pump 21*b*.

The four second temperature sensors 34*a* to 34*d* (which may also be referred to as the second temperature sensors 34) are each provided between the corresponding first heat medium flow switching device 22 and the corresponding heat medium flow control device 25, and detect the temperature of the heat medium flowing out of the corresponding use-side heat exchanger 26. The second temperature sensors 34*a* to 34*d* may each be formed, for example, by a thermistor. The number of the second temperature sensors 34 is determined in accordance with the number of the indoor units 2 installed (which is four here). In the drawing, the second temperature sensor 34*a*, the second temperature sensor 34*b*, the second temperature sensor 34*c*, and the second temperature sensor 34*d* are illustrated, in this order from the bottom of the drawing, to correspond to the respective indoor units 2.

The four third temperature sensors 35*a* to 35*d* (which may also be referred to as the third temperature sensors 35) are each provided on the inlet or outlet side of the corresponding intermediate heat exchanger 15. The third temperature sensors 35*a* to 35*d* each detect the temperature of the heat-source-side refrigerant flowing into the corresponding intermediate heat exchanger 15 or the temperature of the heat-source-side refrigerant flowing out of the corresponding intermediate heat exchanger 15. The third temperature sensors 35*a* to 35*d* may each be formed, for example, by a thermistor. The third temperature sensor 35*a* is provided between the intermediate heat exchanger 15*a* and the second refrigerant flow switching device 18*a*. The third temperature sensor 35*b* is provided between the intermediate heat exchanger 15*a* and the expansion device 16*a*. The third temperature sensor 35*c* is provided between the intermediate heat exchanger 15*b* and the second refrigerant flow switching device 18*b*. The third temperature sensor 35*d* is provided between the intermediate heat exchanger 15*b* and the expansion device 16*b*.

Like the third temperature sensor 35*d*, the pressure sensor 36 is provided between the intermediate heat exchanger 15*b* and the expansion device 16*b*. The pressure sensor 36 detects the pressure of the heat-source-side refrigerant flowing between the intermediate heat exchanger 15*b* and the expansion device 16*b*.

The pipes 5 for circulating the heat medium are each connected to either the intermediate heat exchanger 15*a* or the intermediate heat exchanger 15*b*. The pipes 5 are divided into branches (four branches each here) in accordance with the number of the indoor units 2 connected to the heat medium relay unit 3. The pipes 5 are connected by the first heat medium flow switching devices 22 and the second heat medium flow switching devices 23. Controlling the first heat medium flow switching devices 22 and the second heat medium flow switching devices 23 determines whether to allow the heat medium from the intermediate heat exchanger 15*a* to flow into the use-side heat exchangers 26 and whether to allow the heat medium from the intermediate heat exchanger 15*b* to flow into the use-side heat exchangers 26.

Figure 5:
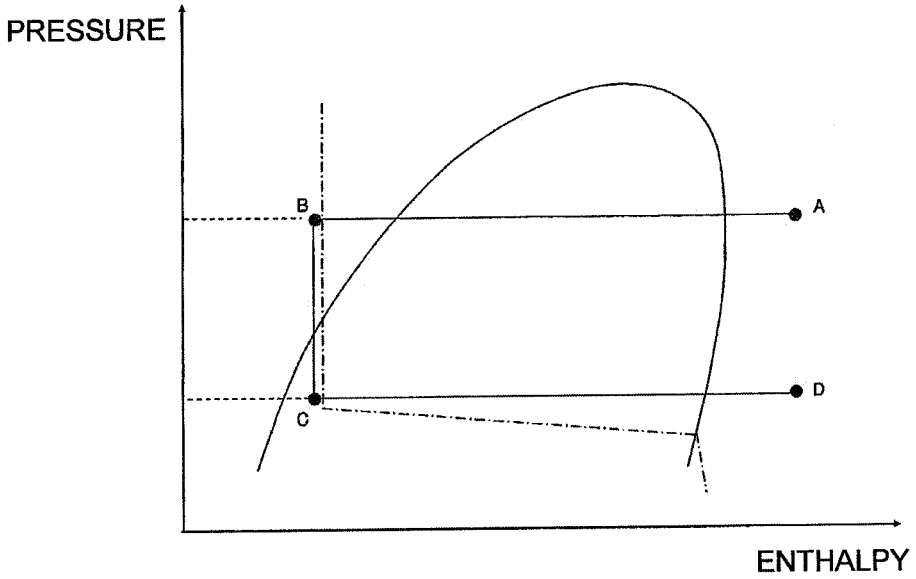
FIG. 5 is a P-H diagram on which points corresponding to points A to D shown in the bypass illustrated in FIG. 3 are plotted.

FIG. 5 is a P-H diagram on which points corresponding to points A to D shown in the bypass illustrated in FIG. 3 are plotted. With reference to FIG. 5, a correspondence between each of points A to D in the bypass 50 and a location on the P-H diagram will be described.

A high-temperature high-pressure gas refrigerant (point A in FIG. 5) discharged from the compressor 10 partially flows into the bypass 50, exchanges heat with a low-pressure refrigerant in the pipe 51*a* (annular part) of the heat exchanging device 51, and turns into a high-pressure liquid refrigerant having a lower enthalpy (point B in FIG. 5). The high-pressure liquid refrigerant is isenthalpically expanded by the expansion device 52 into a low-pressure two-phase gas-liquid state (point C in FIG. 5). The low-pressure two-phase gas-liquid refrigerant flows into the pipe 51*b* of the heat exchanging device 51, exchanges heat with a high-pressure refrigerant, turns into a low-pressure gas refrigerant while increasing its enthalpy (point D in FIG. 5), joins a refrigerant from the accumulator 19, and is sucked into the accumulator 19 again.

Figure 6:
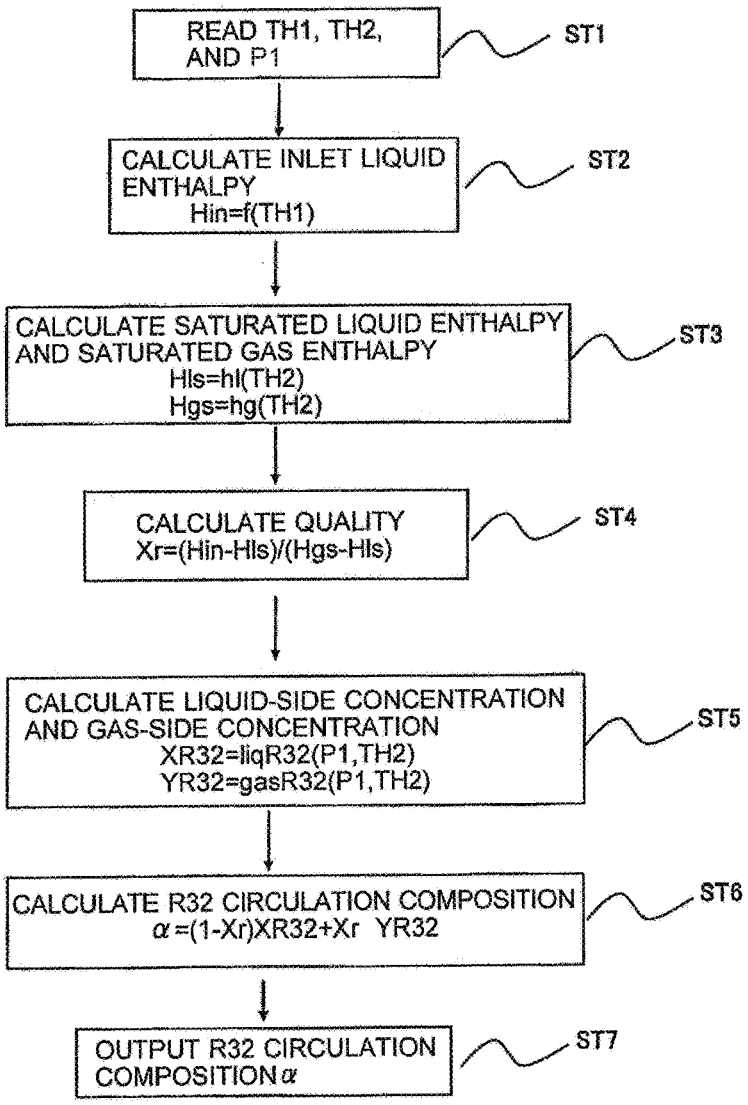
FIG. 6 is a flowchart illustrating a control flow for calculating a refrigerant composition used in the air-conditioning apparatus according to Embodiment.

FIG. 6 is a flowchart illustrating a control flow for calculating a refrigerant composition used in the air-conditioning apparatus 100 according to Embodiment. The control flow performed by the computing device 57 to calculate a refrigerant composition will be described with reference to FIG. 6.

(Step ST1)

The computing device 57 reads a detection result of the inlet temperature sensor 53 (TH1), a detection result of the outlet temperature sensor 54 (TH2), and a detection result of the outlet pressure sensor 55 (P1). Then, the computing device 57 proceeds to step ST2.

(Step ST2)

The computing device 57 tentatively sets a circulating refrigerant composition value, and outputs a physical property table corresponding to the set value. On the basis of the detection result of the inlet temperature sensor 53 read in step ST1 and the physical property table, the computing device 57 calculates an enthalpy Hin (inlet liquid enthalpy) of the refrigerant flowing into the expansion device 52. Then, the computing device 57 proceeds to step ST3.

In Embodiment, the set circulating refrigerant composition refers to a composition ratio of the non-azeotropic refrigerant mixture charged in the air-conditioning apparatus 100. For example, a refrigerant composition that most frequently occurs may be determined by an experiment in advance and set as the circulating refrigerant composition.

(Step ST3)

On the basis of the detection result of the outlet temperature sensor 54 read in step ST1 and the physical property table output in step ST2, the computing device 57 calculates a saturated liquid enthalpy Hs and a saturated gas enthalpy Hgs of the refrigerant flowing out of the expansion device 52. Then, the computing device 57 proceeds to step ST4.

(Step ST4)

The computing device 57 calculates a quality Xr on the basis of the inlet liquid enthalpy Hin calculated in step ST2 and the saturated liquid enthalpy Hs and the saturated gas enthalpy Hgs calculated in step ST3. Then, the computing device 57 proceeds to step ST5.

As described in step ST2, since the composition ratio of the charged non-azeotropic refrigerant mixture is used as the refrigerant composition, the calculated quality Xr is a quality Xr in the charged composition.

(Step ST5)

On the basis of the detection result of the outlet temperature sensor 54 read in step ST1, the detection result of the outlet pressure sensor 55 read in step ST1, and the physical property table, the computing device 57 calculates a concentration XR32 of the liquid refrigerant flowing out of the expansion device 52, and a concentration YR32 of the gas refrigerant flowing out of the expansion device 52. Then, the computing device 57 proceeds to step ST6.

(Step ST6)

The computing device 57 calculates a refrigerant composition a on the basis of the quality Xr calculated in step ST4, the liquid refrigerant concentration XR32 and the gas refrigerant concentration YR32 calculated in step ST5, and Equation 2. Then, the computing device 57 proceeds to step ST7.

(Step ST7)

The computing device 57 outputs the refrigerant composition a calculated in step ST6 to the controller.

Figure 7:
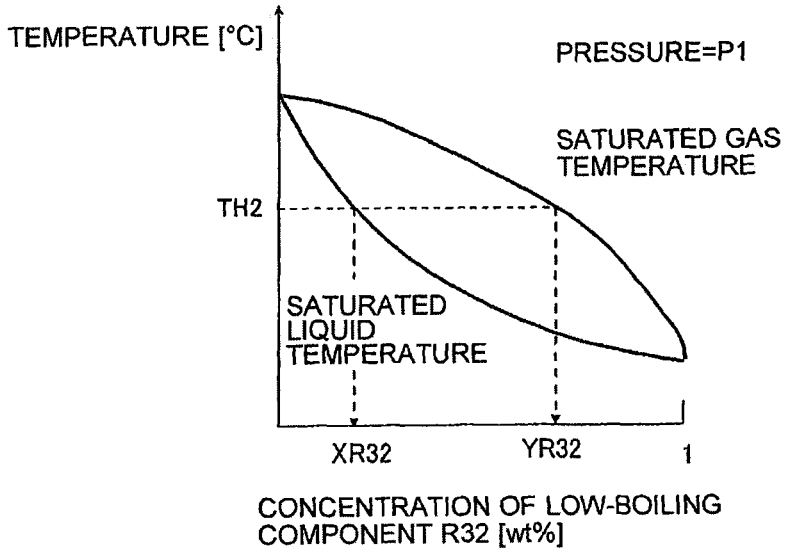
FIG. 7(*a*) illustrates a correlation between a saturated liquid temperature and a liquid refrigerant concentration, and a correlation between a saturated gas temperature of a refrigerant and a gas refrigerant concentration, and FIG. 7(*b*) illustrates a correlation between a quality and a refrigerant composition.
Figure 7:
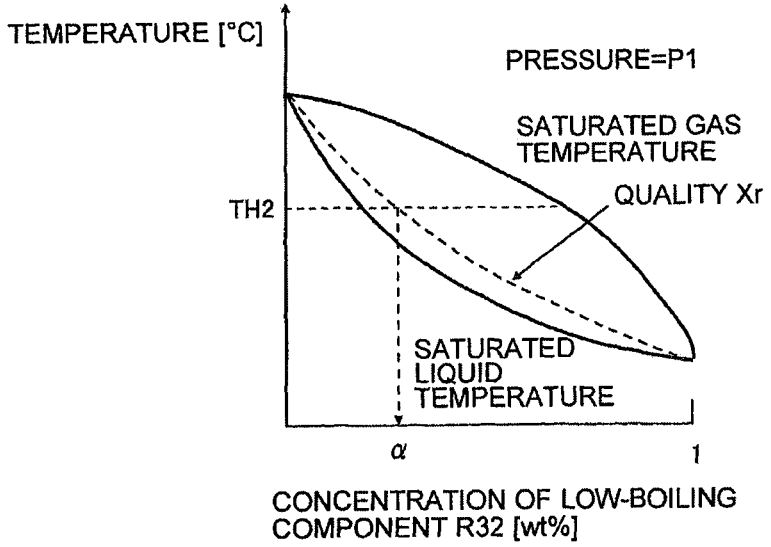

A method for calculating a liquid refrigerant concentration and a gas refrigerant concentration will be described with reference to FIG. 7(*a*), and a method for calculating a refrigerant composition will be described with reference to FIG. 7(*b*). FIG. 7(*a*) illustrates a correlation between a saturated liquid temperature and a liquid refrigerant concentration, and a correlation between a saturated gas temperature of a refrigerant and a gas refrigerant concentration, and FIG. 7(*b*) illustrates a correlation between a quality and a refrigerant composition. In the following description, FIG. 7 may also be referred to as a concentration balance diagram.

Before description of the concentration balance diagram, a degree of freedom of a two-phase gas-liquid refrigerant flowing out of the expansion device 52 will be described. A degree of freedom of a refrigerant can be calculated by the following equation:

$$F=n+2-r$$

where F is a degree of freedom, n is the number of refrigerants mixed, and r is the number of phases.

Since two refrigerants are mixed in the air-conditioning apparatus 100 according to Embodiment, the degree of freedom F in a two-phase gas-liquid state can be expressed as 2+2−2=2. That is, determining two of independent variables of the refrigerant can determine the state of this system. In Embodiment, a temperature and a pressure of the two-phase gas-liquid refrigerant flowing out of the expansion device 52 are detected by the outlet temperature sensor 54 and the outlet pressure sensor 55, respectively. This can determine the state of the two-phase gas-liquid refrigerant in the refrigeration cycle. That is, it is possible to determine a liquid-phase concentration of a low-boiling refrigerant and a gas-phase concentration of the low-boiling refrigerant.

FIG. 7(*a*) actually shows that determining the detection result of the outlet temperature sensor 54 (TH2) and the detection result of the outlet pressure sensor 55 (P1) determines the liquid-phase concentration of the low-boiling refrigerant and the gas-phase concentration of the low-boiling refrigerant.

When the quality calculated in step ST4 is applied to the graph of FIG. 7(*a*), the quality corresponds to a dotted line in FIG. 7(*b*). That is, when the liquid-phase concentration XR32 (liquid-side concentration) and the gas-phase concentration YR32 (gas-side concentration) shown in FIG. 7(*a*) are converted using the quality to the concentration of the low-boiling refrigerant (refrigerant composition), they can be expressed as a in FIG. 7(*b*).

Figure 17:
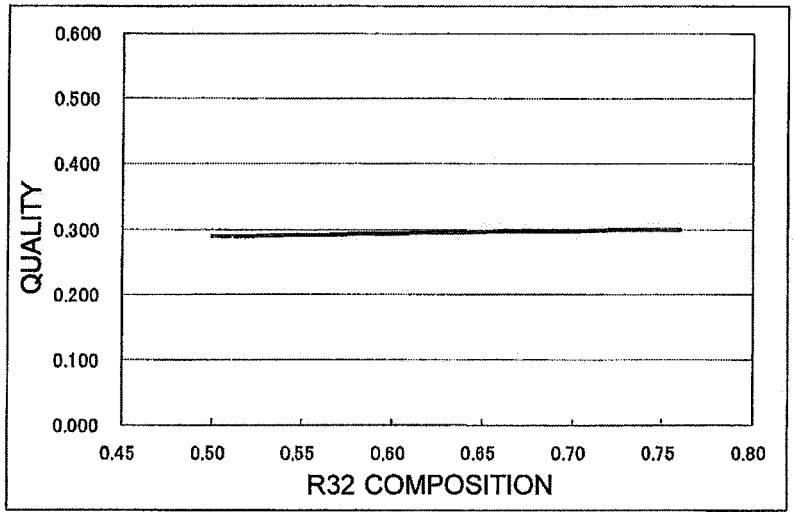
FIG. 17 illustrates a relationship between a quality and a refrigerant composition of R32.

An error in calculating a refrigerant composition in the air-conditioning apparatus 100 according to Embodiment will now be described with reference to FIGS. 8 to 11 and FIG. 17. FIG. 8 is a table for describing to what extent a refrigerant composition set in the control flow for calculating a refrigerant composition gives an error to a calculated refrigerant composition. FIG. 17 illustrates a relationship between a quality and a refrigerant composition of R32.

The refrigerant composition value set in step ST2 corresponds to αb in FIG. 8. A calculated refrigerant composition corresponding to the set value αb is indicated by α. The refrigerant composition is calculated using the detection result of the inlet temperature sensor 53 (TH1)=44 (degrees C.), the detection result of the outlet temperature sensor 54 (TH2)=−3 (degrees C.), and the detection result of the outlet pressure sensor 55 (P1)=0.6 (MPa abs).

Data shown in FIGS. 8 and 9 is obtained when a non-azeotropic refrigerant mixture composed of R32 and R134a is used. This is because using a non-azeotropic refrigerant mixture composed of R32 and R134a provides better data accuracy. The mixture contains 66 wt % R32 and 34 wt % R134a. The physical property values are obtained from the REFPROP Version 8.0 released by the National Institute of Standards and Technology (NIST).

As shown in FIG. 8, even when the refrigerant composition αb tentatively set in step ST2 is changed significantly from 50 wt % to 74 wt %, there is little change in the calculated refrigerant composition α. This result indicates that the method that calculates the quality Xr by setting the refrigerant composition to any value in step ST2 has little effect on the refrigerant composition α eventually obtained.

Therefore, without setting a refrigerant composition and performing repetitive calculations to calculate a refrigerant composition as in the conventional technique, the air-conditioning apparatus 100 according to Embodiment can calculate a refrigerant composition with high accuracy.

It is thus possible to reduce a calculation load on the computing device 57 and a load on the ROM of the computing device 57. Since the calculation load and a capacity load on the ROM can be reduced, there is no need to improve the computing speed of the computing device 57 nor the capacity. This means that the cost of the air-conditioning apparatus 100 can be reduced.

A relationship between the quality Xr and the refrigerant composition α of R32 will now be described with reference to FIG. 17. FIG. 17 shows that there is little change in the quality Xr with a change in the refrigerant composition of R32. The change in the refrigerant composition α thus has little effect on the quality Xr determined in step ST4. Therefore, even when the quality Xr determined from a tentative set value is used, the refrigerant composition α can be calculated with high accuracy.

When calculating the refrigerant composition α, the air-conditioning apparatus 100 according to Embodiment calculates the quality Xr in step ST4 and calculates the liquid refrigerant concentration XR32 and the gas refrigerant concentration YR32 in step ST5. Then in step ST7, the air-conditioning apparatus 100 calculates the refrigerant composition from the calculated quality Xr, liquid refrigerant concentration XR32, and gas refrigerant concentration YR32.

That is, the best way to estimate the refrigerant composition may be to use, through the use of the quality, the concentration balance diagram obtained from the detection result of the outlet temperature sensor 54 and the detection result of the outlet pressure sensor 55. Therefore, the air-conditioning apparatus 100 according to Embodiment uses this calculation method and calculates a refrigerant composition with high accuracy.

FIG. 9 is a table for describing to what extent various detection results in the control flow for calculating a refrigerant composition give an error to a calculated refrigerant composition. With reference to FIG. 9, an error given by the detection result of the inlet temperature sensor 53 to the calculated refrigerant composition will be specifically described.

FIG. 9 shows the detected refrigerant composition α in two ways, α (table) and α (detailed version). Specifically, α (table) provides refrigerant compositions calculated using a physical property table of the computing device 57, whereas α (detailed version) provides refrigerant compositions calculated not by using the physical property table, but by detailed analysis using the REFPROP Version 8.0.

Although the table is used in Embodiment, it is found that by using either the physical property table or the REFPROP Version 8.0, substantially the same refrigerant compositions are obtained. This means that the air-conditioning apparatus 100 according to Embodiment has good calculation accuracy.

As shown in FIG. 9, even when the temperature detected by the inlet temperature sensor 53 changes ±1 (degree C.), the circulation composition changes only ±0.1% (see Nos. 1 to 3 in FIG. 9). This result shows that the inlet temperature sensor 53 preferably has an accuracy of ±1 (degree C.).

Figure 10:
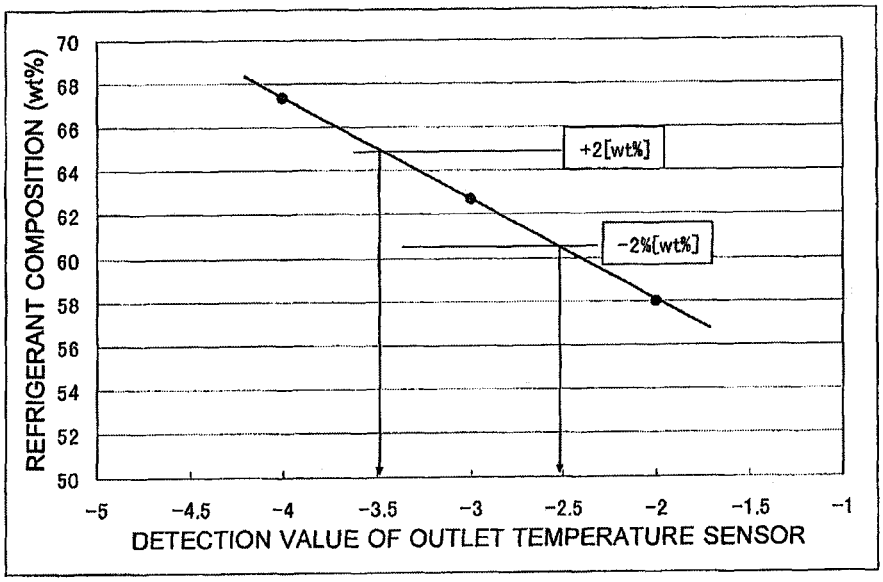
FIG. 10 is a graph for describing to what extent a detection result of an outlet temperature sensor gives an error to a calculated refrigerant composition.

FIG. 10 is a graph for describing to what extent a detection result of the outlet temperature sensor 54 gives an error to a calculated refrigerant composition.

FIG. 10 shows that to keep an error in a calculated refrigerant composition within, for example, about ±2 (wt %) (or about ±3% in ratio), the outlet temperature sensor 54 preferably has a detection accuracy of about ±0.5 (degrees C.).

Figure 11:
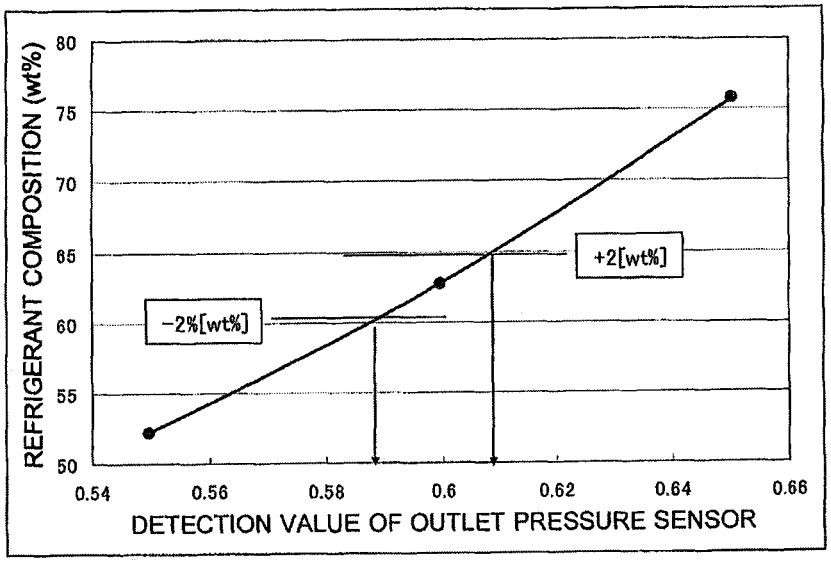
FIG. 11 is a graph for describing to what extent a detection result of an outlet pressure sensor gives an error to a calculated refrigerant composition.

FIG. 11 is a graph for describing to what extent a detection result of the outlet pressure sensor 55 gives an error to a calculated refrigerant composition.

FIG. 11 shows that to keep an error in a calculated refrigerant composition within, for example, about ±2 (wt %) (or about ±3% in ratio), the outlet pressure sensor 55 preferably has a detection accuracy of about ±0.01 (MPa).

As shown in FIGS. 9 to 11, when the detection results of the inlet temperature sensor 53, the outlet temperature sensor 54, and the outlet pressure sensor 55 fall within the ranges described above, the computing device 57 can calculate the refrigerant composition with high accuracy. Since this makes it possible for the controller to calculate the evaporation temperature, the condensing temperature, the saturation temperature, the degree of superheat, and the degree of subcooling with high accuracy, it is possible to optimally control the opening degrees of the expansion devices 16, the rotation speed of the compressor 10, and the speeds (including ON/OFF) of the fans for the heat-source-side heat exchanger 12 and the use-side heat exchangers 26.

Figure 12:
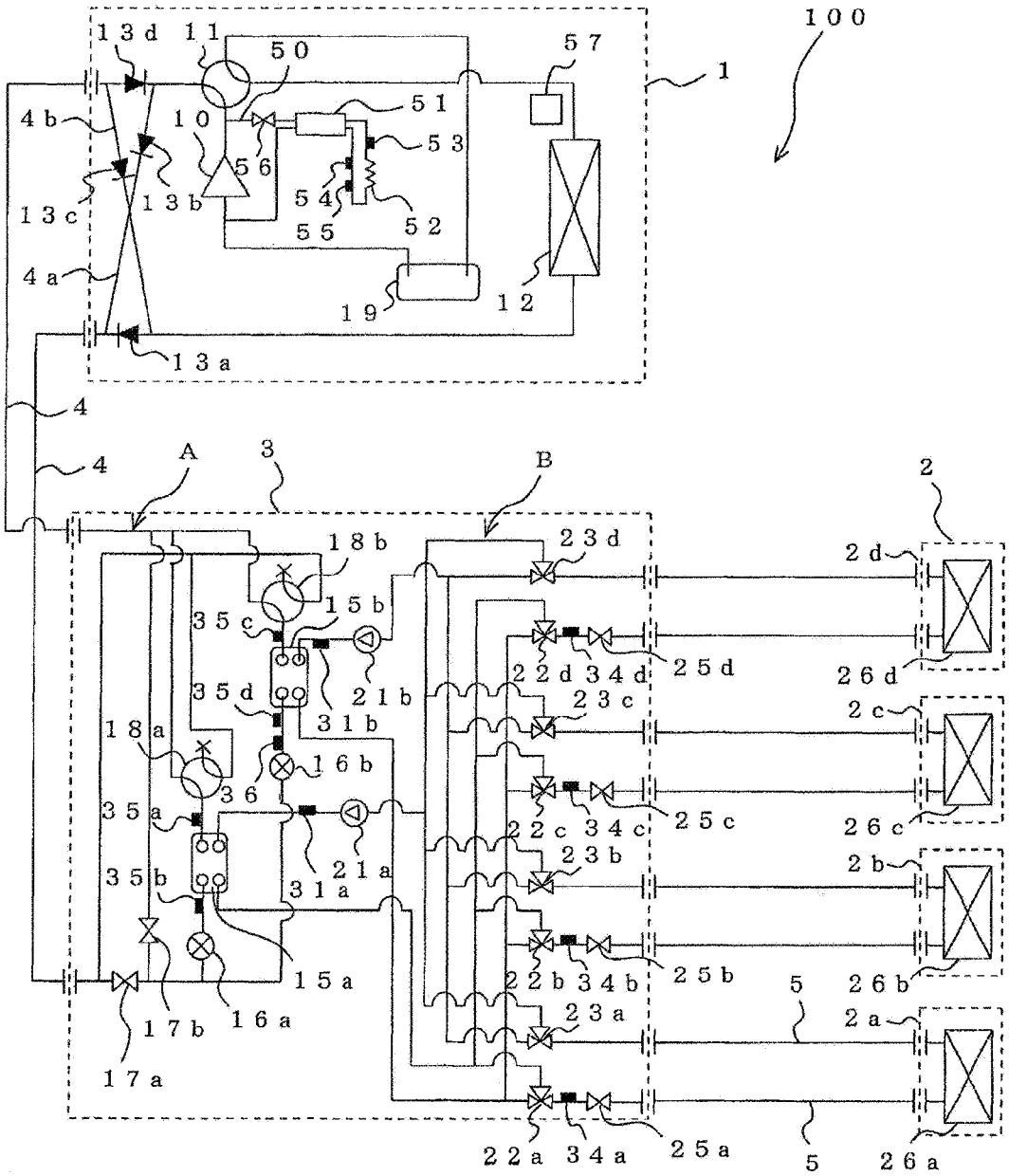
FIG. 12 illustrates a configuration in which an opening and closing device is added to the bypass illustrated in FIG. 3.

FIG. 12 illustrates a configuration in which an opening and closing device 56 is added to the bypass 50 illustrated in FIG. 3. When the opening and closing device 56 is included in the bypass 50, the opening and closing device 56 is brought into a closed state in non-stationary operation (e.g., defrosting operation, switching of operation mode, or start-up) to prevent the refrigerant from flowing in the bypass. When the operation is stable, the opening and closing device 56 is opened for a predetermined period of time at predetermined intervals to calculate the refrigerant composition.

For example, in the defrosting operation, bringing the opening and closing device 56 into a closed state prevents the refrigerant from flowing into the bypass 50 and reduces the amount of refrigerant flowing into the heat-source-side heat exchanger 12. This makes it possible to perform the defrosting operation with high efficiency. That is, by controlling the opening and closing of the opening and closing device 56, it is possible to reduce a decrease in operation efficiency in non-stationary and stable operations, and improve operation reliability of the air-conditioning apparatus 100.

Although FIG. 10 illustrates the opening and closing device 56 provided in the pipe that connects the discharge side of the compressor 10 and the heat exchanging device 51, the location of the opening and closing device 56 is not limited to this. The opening and closing device 56 has the same effect wherever it is located in the bypass 50.

The opening and closing device 56 may be formed, for example, by a solenoid valve.

[Description of Operation Modes]

The air-conditioning apparatus 100 includes the compressor 10, the first refrigerant flow switching device 11, the heat-source-side heat exchanger 12, the opening and closing devices 17, the second refrigerant flow switching devices 18, the refrigerant passages of the intermediate heat exchanger 15*a*, the expansion devices 16, and the accumulator 19 that are connected by the refrigerant pipes 4 to form the refrigerant circuit A. The air-conditioning apparatus 100 also includes the heat medium passages of the intermediate heat exchanger 15*a*, the pumps 21, the first heat medium flow switching devices 22, the heat medium flow control devices 25, the use-side heat exchangers 26, and the second heat medium flow switching devices 23 that are connected by the pipes 5 to form the heat medium circuit B. That is, a plurality of use-side heat exchangers 26 are connected in parallel to each of the intermediate heat exchangers 15 to form the heat medium circuit B composed of multiple systems.

In the air-conditioning apparatus 100, the outdoor unit 1 and the heat medium relay unit 3 are connected via the intermediate heat exchanger 15*a* and the intermediate heat exchanger 15*b* included in the heat medium relay unit 3, and the heat medium relay unit 3 and the indoor units 2 are also connected via the intermediate heat exchanger 15*a* and the intermediate heat exchanger 15*b*. That is, in the air-conditioning apparatus 100, the intermediate heat exchanger 15*a* and the intermediate heat exchanger 15*b* allow heat exchange between the heat-source-side refrigerant circulating in the refrigerant circuit A and the heat medium circulating the heat medium circuit B.

Each operation mode performed by the air-conditioning apparatus 100 will now be described. In accordance with an instruction from each indoor unit 2, the air-conditioning apparatus 100 performs a heating operation or a cooling operation in the indoor unit 2. That is, the air-conditioning apparatus 100 can perform either the same operation in all the indoor units 2 or a different operation in each indoor unit 2.

The operation modes performed by the air-conditioning apparatus 100 include the cooling only operation mode where all indoor units 2 in operation perform a cooling operation, the heating only operation mode where all indoor units 2 in operation perform a heating operation, the cooling main operation mode which is a cooling and heating mixed operation mode where a cooling load is greater, and the heating main operation mode which is a cooling and heating mixed operation mode where a heating load is greater. Each operation mode will now be described together with the flows of the heat-source-side refrigerant and the heat medium.

[Cooling Only Operation Mode]

Figure 13:
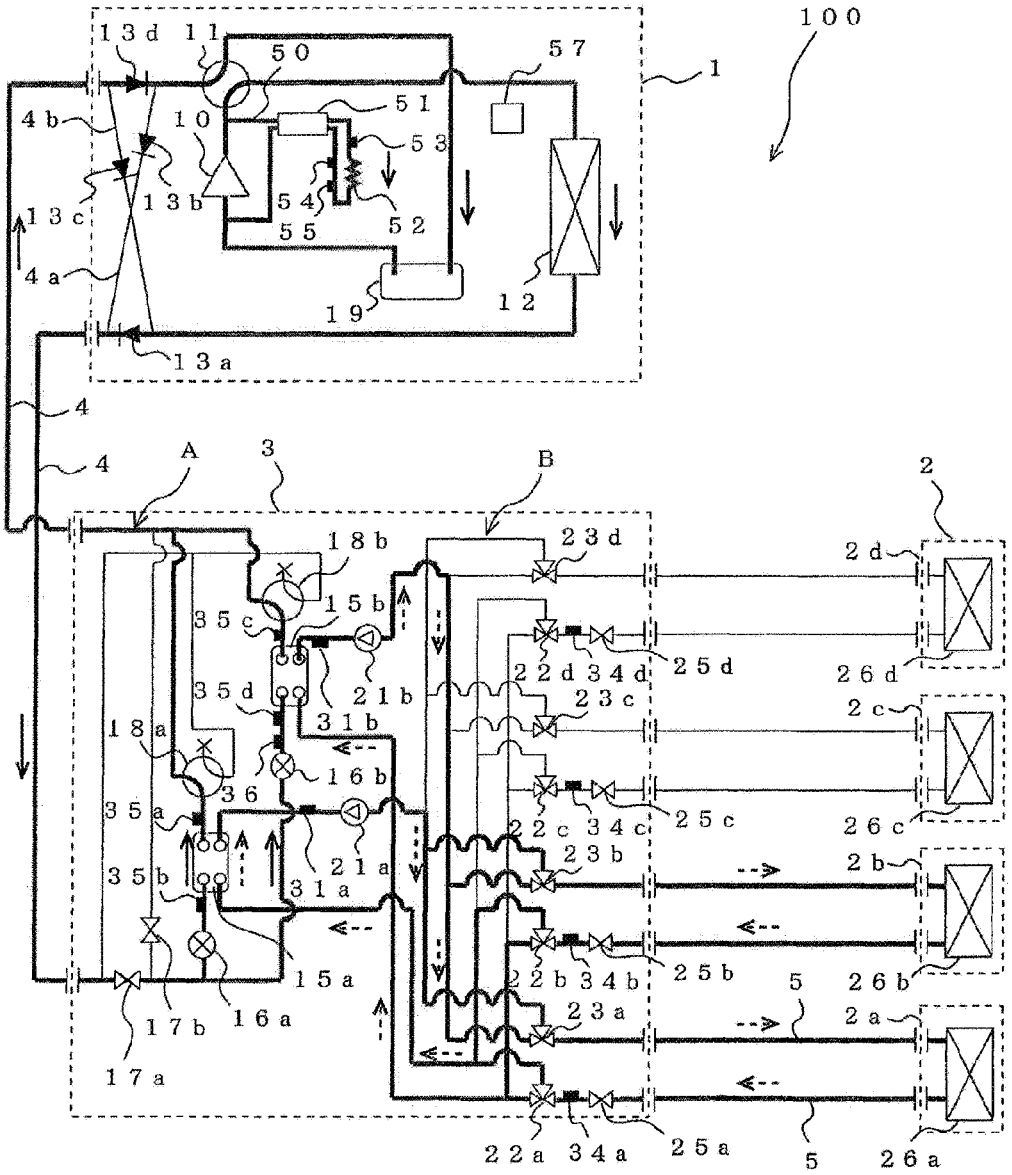
FIG. 13 is a refrigerant circuit diagram illustrating flows of refrigerant in a cooling only operation mode of the air-conditioning apparatus illustrated in FIG. 2.

FIG. 13 is a refrigerant circuit diagram illustrating flows of refrigerant in the cooling only operation mode of the air-conditioning apparatus 100 illustrated in FIG. 2. FIG. 13 illustrates the cooling only operation mode using an example where a cooling energy load is generated only in the use-side heat exchanger 26*a* and the use-side heat exchanger 26*b*. In FIG. 13, pipes indicated by thick lines are those through which the refrigerants (the heat-source-side refrigerant and the heat medium) flow. Also in FIG. 13, the direction of flow of the heat-source-side refrigerant is indicated by solid arrows, and the direction of flow of the heat medium is indicated by dashed arrows.

In the cooling only operation mode illustrated in FIG. 13, the outdoor unit 1 switches the first refrigerant flow switching device 11 such that the heat-source-side refrigerant discharged from the compressor 10 flows into the heat-source-side heat exchanger 12. The heat medium relay unit 3 drives the pump 21*a* and the pump 21*b*, opens the heat medium flow control device 25*a* and the heat medium flow control device 25*b*, and fully closes the heat medium flow control device 25*c* and the heat medium flow control device 25*d*, so that the heat medium circulates between each of the intermediate heat exchanger 15*a* and the intermediate heat exchanger 15*b* and the corresponding one of the use-side heat exchanger 26*a* and the use-side heat exchanger 26*b*.

First, the flow of the heat-source-side refrigerant in the refrigerant circuit A will be described.

A low-temperature low-pressure refrigerant is compressed by the compressor 10 into a high-temperature high-pressure gas refrigerant and discharged. The high-temperature high-pressure gas refrigerant discharged from the compressor 10 partially flows into the bypass 50 and into the heat exchanging device 51, exchanges heat with a low-temperature low-pressure refrigerant, and turns into a high-pressure liquid refrigerant. The high-pressure liquid refrigerant is pressure-reduced by the expansion device 52, turns into a two-phase gas-liquid low-pressure refrigerant, flows into the heat exchanging device 51, turns into a gas refrigerant under the influence of a high-temperature high-pressure refrigerant, joins a gas refrigerant from the accumulator 19, and is sucked into the compressor 10. On the other hand, the remaining part of the high-temperature high-pressure gas refrigerant discharged from the compressor 10 passes through the first refrigerant flow switching device 11, flows into the heat-source-side heat exchanger 12, and turns into a high-pressure liquid refrigerant while transferring heat to the outdoor air. After flowing out of the heat-source-side heat exchanger 12, the high-pressure refrigerant passes through the check valve 13*a*, flows out of the outdoor unit 1, passes through the refrigerant pipe 4, and flows into the heat medium relay unit 3. After flowing into the heat medium relay unit 3 and passing through the opening and closing device 17*a*, the high-pressure refrigerant is divided and flows into the expansion device 16*a* and the expansion device 16*b*. The high-pressure refrigerant is expanded by each of the expansion device 16*a* and the expansion device 16*b* turns into a low-temperature low-pressure two-phase refrigerant. Note that the opening and closing device 17*b* is in a closed state.

The two-phase refrigerant flows into the intermediate heat exchanger 15*a* and the intermediate heat exchanger 15*b*, each serving as an evaporator, and turns into a low-temperature low-pressure gas refrigerant while cooling the heat medium by receiving heat from the heat medium circulating in the heat medium circuit B. The gas refrigerant flowing out of the intermediate heat exchanger 15*a* and the intermediate heat exchanger 15*b* passes through the second refrigerant flow switching device 18*a* and the second refrigerant flow switching device 18*b*, flows out of the heat medium relay unit 3, passes through the refrigerant pipe 4, and flows into the outdoor unit 1 again. After flowing into the outdoor unit 1, the refrigerant passes through the check valve 13*d*, the first refrigerant flow switching device 11, and the accumulator 19, and is sucked into the compressor 10 again.

The second refrigerant flow switching device 18*a* and the second refrigerant flow switching device 18*b* communicate with low-pressure pipes. The opening degree of the expansion device 16*a* is controlled such that a degree of superheat, which is obtained as a difference between a temperature detected by the third temperature sensor 35*a* and a temperature detected by the third temperature sensor 35*b*, is constant. Similarly, the opening degree of the expansion device 16*b* is controlled such that a degree of superheat, which is obtained as a difference between a temperature detected by the third temperature sensor 35*c* and a temperature detected by the third temperature sensor 35*d*, is constant.

Next, the flow of the heat medium in the heat medium circuit B will be described.

In the cooling only operation mode, both the intermediate heat exchanger 15*a* and the intermediate heat exchanger 15*b* transfer cooling energy of the heat-source-side refrigerant to the heat medium, and the pump 21*a* and the pump 21*b* cause the cooled heat medium to flow through the pipes 5. After being pressurized by the pump 21*a* and the pump 21*b* and flowing out thereof, the heat medium passes through the second heat medium flow switching device 23*a* and the second heat medium flow switching device 23*b* and flows into the use-side heat exchanger 26*a* and the use-side heat exchanger 26*b*, where the heat medium receives heat from indoor air to cool the indoor space 7.

Then, the heat medium flows out of the use-side heat exchanger 26*a* and the use-side heat exchanger 26*b* and flows into the heat medium flow control device 25*a* and the heat medium flow control device 25*b*. The actions of the heat medium flow control device 25*a* and the heat medium flow control device 25*b* allow the heat medium to flow into the use-side heat exchanger 26*a* and the use-side heat exchanger 26*b* while controlling a flow rate of the heat medium to a level necessary to compensate for an air conditioning load required in the indoor space. After flowing out of the heat medium flow control device 25*a* and the heat medium flow control device 25*b*, the heat medium passes through the first heat medium flow switching device 22*a* and the first heat medium flow switching device 22*b*, flows into the intermediate heat exchanger 15*a* and the intermediate heat exchanger 15*b*, and is sucked into the pump 21*a* and the pump 21*b* again.

In the pipes 5 of the use-side heat exchangers 26, the heat medium flows in the direction from the second heat medium flow switching devices 23 through the heat medium flow control devices 25 to the first heat medium flow switching devices 22. The air conditioning load required in the indoor space 7 can be compensated by controlling a difference between a temperature detected by the first temperature sensor 31*a* or the first temperature sensor 31*b* and a temperature detected by the corresponding second temperature sensor 34 such that the difference is maintained as a target value. A temperature detected by one of the first temperature sensor 31*a* and the first temperature sensor 31*b*, or an average of temperatures detected by the two may be used as an outlet temperature of the intermediate heat exchangers 15. The opening degrees of the first heat medium flow switching devices 22 and the second heat medium flow switching devices 23 are set to a medium level so that passages to both the intermediate heat exchanger 15*a* and the intermediate heat exchanger 15*b* are secured.

In the execution of the cooling only operation mode, since it is not necessary to supply the heat medium to any use-side heat exchanger 26 having no heat load (including thermo-off), the corresponding heat medium flow control device 25 closes the passage to prevent the heat medium from flowing into the use-side heat exchanger 26. In FIG. 13, the heat medium is supplied to the use-side heat exchanger 26*a* and the use-side heat exchanger 26*b* because they have a heat load. The use-side heat exchanger 26*c* and the use-side heat exchanger 26*d* have no heat load, and the corresponding heat medium flow control device 25*c* and heat medium flow control device 25*d* are fully closed. When a heat load is generated in the use-side heat exchanger 26*c* or the use-side heat exchanger 26*d*, the heat medium flow control device 25*c* or the heat medium flow control device 25*d* may be opened to allow the heat medium to circulate.

[Heating Only Operation Mode]

Figure 14:
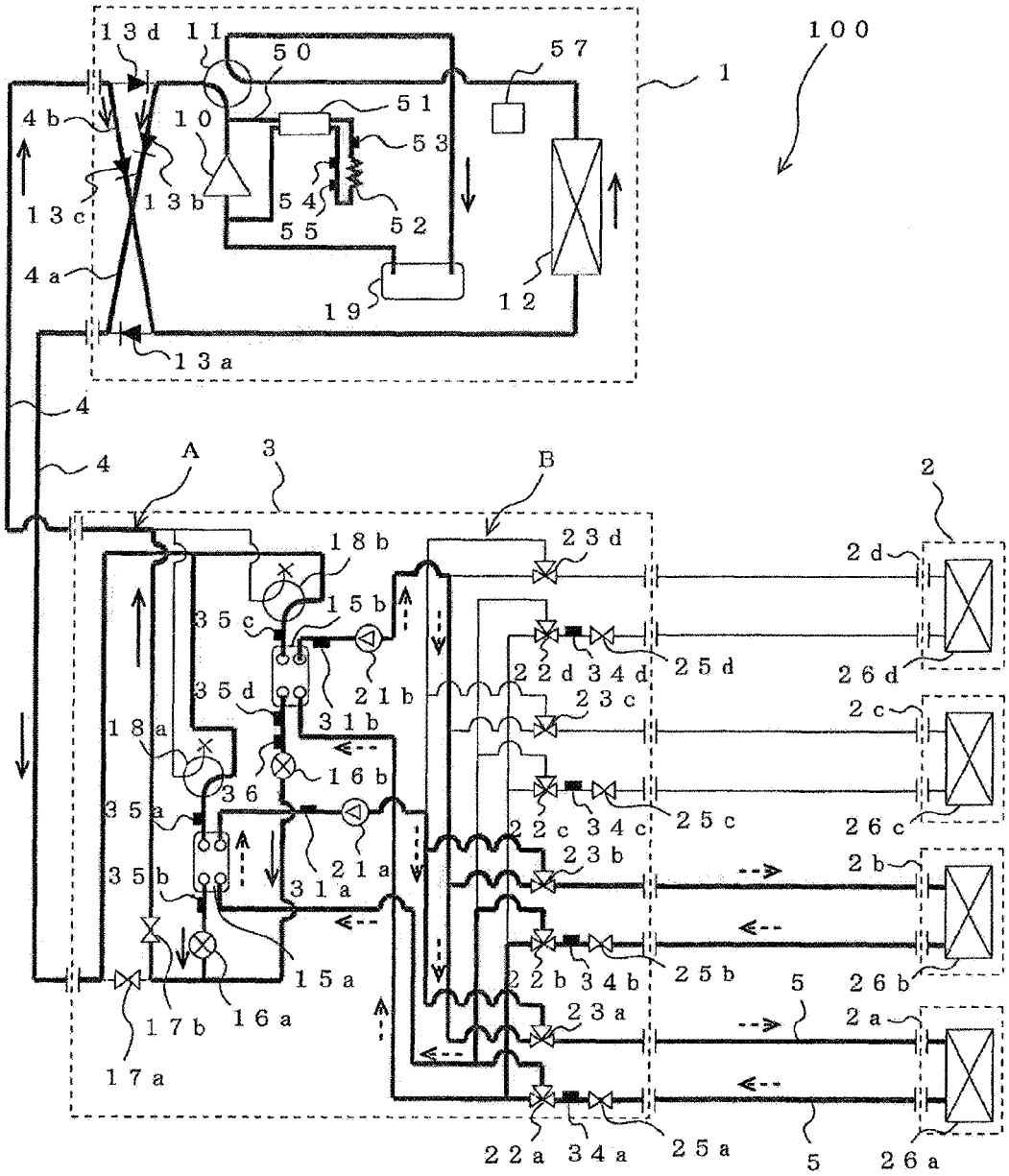
FIG. 14 is a refrigerant circuit diagram illustrating flows of refrigerant in a heating only operation mode of the air-conditioning apparatus illustrated in FIG. 2.

FIG. 14 is a refrigerant circuit diagram illustrating flows of refrigerant in the heating only operation mode of the air-conditioning apparatus 100 illustrated in FIG. 2. FIG. 14 illustrates the heating only operation mode using an example where a heating energy load is generated only in the use-side heat exchanger 26*a* and the use-side heat exchanger 26*b*. In FIG. 14, pipes indicated by thick lines are those through which the refrigerants (the heat-source-side refrigerant and the heat medium) flow. Also in FIG. 14, the direction of flow of the heat-source-side refrigerant is indicated by solid arrows, and the direction of flow of the heat medium is indicated by dashed arrows.

In the heating only operation mode illustrated in FIG. 14, the outdoor unit 1 switches the first refrigerant flow switching device 11 such that the heat-source-side refrigerant discharged from the compressor 10 flows into the heat medium relay unit 3 without passing through the heat-source-side heat exchanger 12. The heat medium relay unit 3 drives the pump 21*a* and the pump 21*b*, opens the heat medium flow control device 25*a* and the heat medium flow control device 25*b*, and fully closes the heat medium flow control device 25*c* and the heat medium flow control device 25*d*, so that the heat medium circulates between each of the intermediate heat exchanger 15*a* and the intermediate heat exchanger 15*b* and the corresponding one of the use-side heat exchanger 26*a* and the use-side heat exchanger 26*b*.

First, the flow of the heat-source-side refrigerant in the refrigerant circuit A will be described.

A low-temperature low-pressure refrigerant is compressed by the compressor 10 into a high-temperature high-pressure gas refrigerant and discharged. The high-temperature high-pressure gas refrigerant discharged from the compressor 10 partially flows into the bypass 50 and into the heat exchanging device 51, exchanges heat with a low-temperature low-pressure refrigerant, and turns into a high-pressure liquid refrigerant. The high-pressure liquid refrigerant is pressure-reduced by the expansion device 52, turns into a two-phase gas-liquid low-pressure refrigerant, flows into the heat exchanging device 51, turns into a gas refrigerant under the influence of a high-temperature high-pressure refrigerant, joins a gas refrigerant from the accumulator 19, and is sucked into the compressor 10. On the other hand, the remaining part of the high-temperature high-pressure gas refrigerant discharged from the compressor 10 passes through the first refrigerant flow switching device 11 and the check valve 13*b*, and flows out of the outdoor unit 1. The high-temperature high-pressure gas refrigerant flowing out of the outdoor unit 1 passes through the refrigerant pipe 4, and flows into the heat medium relay unit 3. After flowing into the heat medium relay unit 3, the high-temperature high-pressure gas refrigerant is divided, passes through each of the second refrigerant flow switching device 18*a* and the second refrigerant flow switching device 18*b*, and flows into each of the intermediate heat exchanger 15*a* and the intermediate heat exchanger 15*b*.

After flowing into each of the intermediate heat exchanger 15*a* and the intermediate heat exchanger 15*b*, the high-temperature high-pressure gas refrigerant turns into a high-pressure liquid refrigerant while transferring heat to the heat medium circulating in the heat medium circuit B. The high-pressure liquid refrigerant flowing out of the intermediate heat exchanger 15*a* and the intermediate heat exchanger 15*b* is expanded by the expansion device 16*a* and the expansion device 16*b* into a low-temperature low-pressure two-phase refrigerant. The two-phase refrigerant passes through the opening and closing device 17*b*, flows out of the heat medium relay unit 3, passes through the refrigerant pipe 4, and flows into the outdoor unit 1 again. Note that the opening and closing device 17*a* is in a closed state.

After flowing into the outdoor unit 1, the refrigerant passes through the check valve 13*c* and flows into the heat-source-side heat exchanger 12 serving as an evaporator. In the heat-source-side heat exchanger 12, the refrigerant receives heat from the outdoor air and turns into a low-temperature low-pressure gas refrigerant. The low-temperature low-pressure gas refrigerant flowing out of the heat-source-side heat exchanger 12 passes through the first refrigerant flow switching device 11 and the accumulator 19, and is sucked into the compressor 10 again.

The second refrigerant flow switching device 18*a* and the second refrigerant flow switching device 18*b* communicate with high-pressure pipes. The opening degree of the expansion device 16*a* is controlled such that a degree of subcooling, which is obtained as a difference between a saturation temperature determined by converting a pressure detected by the pressure sensor 36 and a temperature detected by the third temperature sensor 35*b*, is constant. Similarly, the opening degree of the expansion device 16*b* is controlled such that a degree of subcooling, which is obtained as a difference between a saturation temperature determined by converting a pressure detected by the pressure sensor 36 and a temperature detected by the third temperature sensor 35*d*, is constant. Note that if a temperature at an intermediate position between the intermediate heat exchangers 15 can be measured, the temperature at the intermediate position may be used instead of using the pressure sensor 36. This can reduce the cost of producing a system.

Next, the flow of the heat medium in the heat medium circuit B will be described.

In the heating only operation mode, both the intermediate heat exchanger 15*a* and the intermediate heat exchanger 15*b* transfer heating energy of the heat-source-side refrigerant to the heat medium, and the pump 21*a* and the pump 21*b* cause the heated heat medium to flow through the pipes 5. After being pressurized by the pump 21*a* and the pump 21*b* and flowing out thereof, the heat medium passes through the second heat medium flow switching device 23*a* and the second heat medium flow switching device 23*b* and flows into the use-side heat exchanger 26*a* and the use-side heat exchanger 26*b*, where the heat medium transfers heat to the indoor air to heat the indoor space 7.

Then, the heat medium flows out of the use-side heat exchanger 26*a* and the use-side heat exchanger 26*b* and flows into the heat medium flow control device 25*a* and the heat medium flow control device 25*b*. The actions of the heat medium flow control device 25*a* and the heat medium flow control device 25*b* allow the heat medium to flow into the use-side heat exchanger 26*a* and the use-side heat exchanger

26*b* while controlling a flow rate of the heat medium to a level necessary to compensate for an air conditioning load required in the indoor space. After flowing out of the heat medium flow control device 25*a* and the heat medium flow control device 25*b*, the heat medium passes through the first heat medium flow switching device 22*a* and the first heat medium flow switching device 22*b*, flows into the intermediate heat exchanger 15*a* and the intermediate heat exchanger 15*b*, and is sucked into the pump 21*a* and the pump 21*b* again.

In the pipes 5 of the use-side heat exchangers 26, the heat medium flows in the direction from the second heat medium flow switching devices 23 through the heat medium flow control devices 25 to the first heat medium flow switching devices 22. The air conditioning load required in the indoor space 7 can be compensated by controlling a difference between a temperature detected by the first temperature sensor 31*a* or the first temperature sensor 31*b* and a temperature detected by the corresponding second temperature sensor 34 such that the difference is maintained as a target value. A temperature detected by one of the first temperature sensor 31*a* and the first temperature sensor 31*b*, or an average of temperatures detected by the two may be used as an outlet temperature of the intermediate heat exchangers 15.

The opening degrees of the first heat medium flow switching devices 22 and the second heat medium flow switching devices 23 are set to a medium level so that passages to both the intermediate heat exchanger 15*a* and the intermediate heat exchanger 15*b* are secured. The use-side heat exchanger 26*a* essentially needs to be controlled in accordance with a difference between a temperature at its inlet and that at its outlet. However, since the temperature of the heat medium on the inlet side of the use-side heat exchanger 26 is substantially the same as that detected by the first temperature sensor 31*b*, using the first temperature sensor 31*b* can reduce the number of temperature sensors, so that the cost of producing the system can be reduced.

In the execution of the heating only operation mode, since it is not necessary to supply the heat medium to any use-side heat exchanger 26 having no heat load (including thermo-off), the corresponding heat medium flow control device 25 closes the passage to prevent the heat medium from flowing into the use-side heat exchanger 26. In FIG. 14, the heat medium is supplied to the use-side heat exchanger 26*a* and the use-side heat exchanger 26*b* because they have a heat load. The use-side heat exchanger 26*c* and the use-side heat exchanger 26*d* have no heat load, and the corresponding heat medium flow control device 25*c* and heat medium flow control device 25*d* are fully closed. When a heat load is generated in the use-side heat exchanger 26*c* or the use-side heat exchanger 26*d*, the heat medium flow control device 25*c* or the heat medium flow control device 25*d* may be opened to allow the heat medium to circulate.

[Cooling Main Operation Mode]

Figure 15:
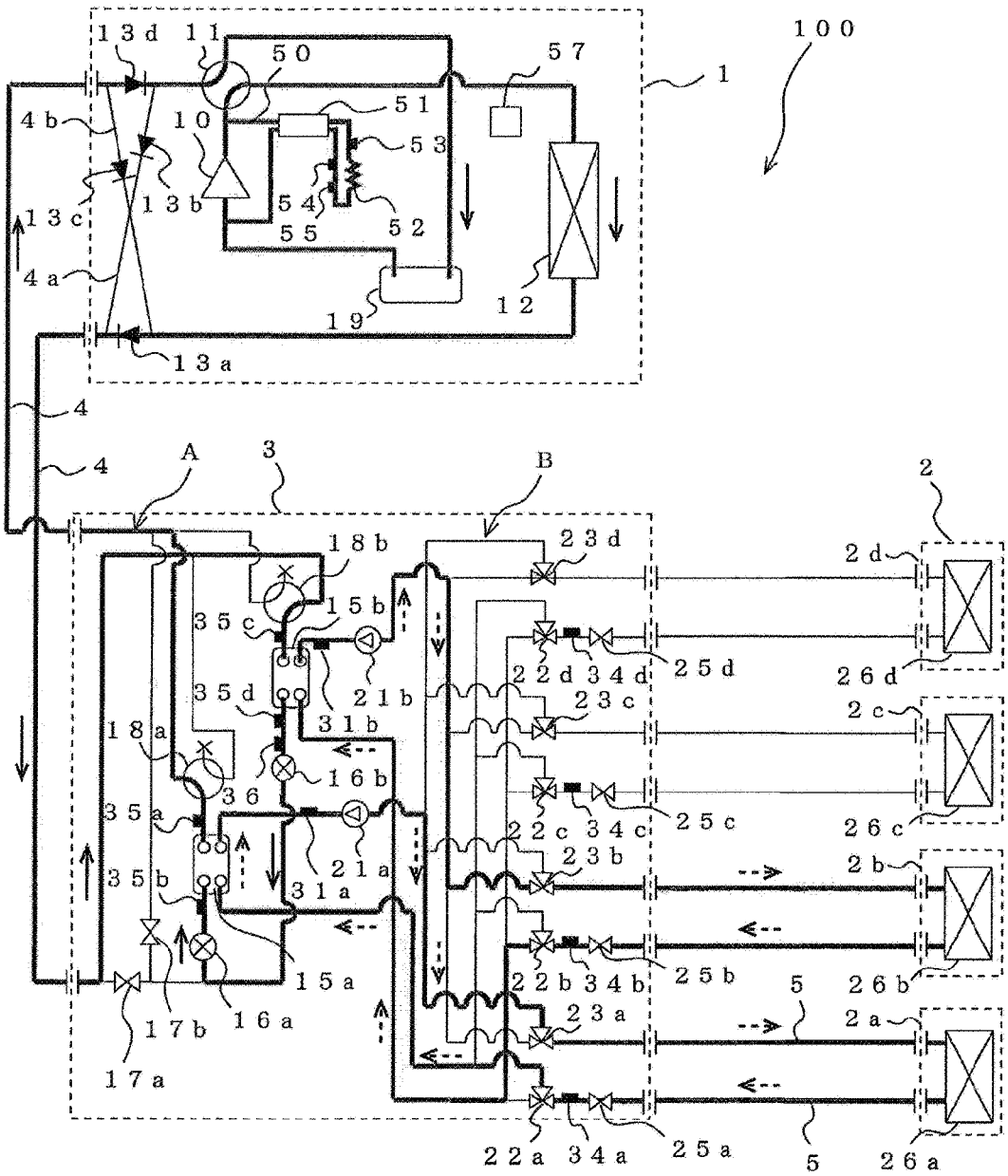
FIG. 15 is a refrigerant circuit diagram illustrating flows of refrigerant in a cooling main operation mode of the air-conditioning apparatus illustrated in FIG. 2.

FIG. 15 is a refrigerant circuit diagram illustrating flows of refrigerant in the cooling main operation mode of the air-conditioning apparatus 100 illustrated in FIG. 2. FIG. 15 illustrates the cooling main operation mode using an example where a cooling energy load is generated in the use-side heat exchanger 26*a* and a heating energy load is generated in the use-side heat exchanger 26*b*. In FIG. 15, pipes indicated by thick lines are those through which the refrigerants (the heat-source-side refrigerant and the heat medium) circulate. Also in FIG. 15, the direction of flow of the heat-source-side refrigerant is indicated by solid arrows, and the direction of flow of the heat medium is indicated by dashed arrows.

In the cooling main operation mode illustrated in FIG. 15, the outdoor unit 1 switches the first refrigerant flow switching device 11 such that the heat-source-side refrigerant discharged from the compressor 10 flows into the heat-source-side heat exchanger 12. The heat medium relay unit 3 drives the pump 21*a* and the pump 21*b*, opens the heat medium flow control device 25*a* and the heat medium flow control device 25*b*, and fully closes the heat medium flow control device 25*c* and the heat medium flow control device 25*d*, so that the heat medium circulates between the intermediate heat exchanger 15*a* and the use-side heat exchanger 26*a* and between the intermediate heat exchanger 15*b* and the use-side heat exchanger 26*b*.

First, the flow of the heat-source-side refrigerant in the refrigerant circuit A will be described.

A low-temperature low-pressure refrigerant is compressed by the compressor 10 into a high-temperature high-pressure gas refrigerant and discharged. The high-temperature high-pressure gas refrigerant discharged from the compressor 10 partially flows into the bypass 50 and into the heat exchanging device 51, exchanges heat with a low-temperature low-pressure refrigerant, and turns into a high-pressure liquid refrigerant. The high-pressure liquid refrigerant is pressure-reduced by the expansion device 52, turns into a two-phase gas-liquid low-pressure refrigerant, flows into the heat exchanging device 51, turns into a gas refrigerant under the influence of a high-temperature high-pressure refrigerant, joins a gas refrigerant from the accumulator 19, and is sucked into the compressor 10. On the other hand, the remaining part of the high-temperature high-pressure gas refrigerant discharged from the compressor 10 passes through the first refrigerant flow switching device 11, flows into the heat-source-side heat exchanger 12, and turns into a liquid refrigerant while transferring heat to the outdoor air. After flowing out of the heat-source-side heat exchanger 12, the refrigerant flows out of the outdoor unit 1, passes through the check valve 13*a* and the refrigerant pipe 4, and flows into the heat medium relay unit 3. After flowing into the heat medium relay unit 3, the refrigerant passes through the second refrigerant flow switching device 18*b* and flows into the intermediate heat exchanger 15*b* serving as a condenser.

In the intermediate heat exchanger 15*b*, the refrigerant further lowers its temperature by transferring heat to the heat medium circulating in the heat medium circuit B. The refrigerant flowing out of the intermediate heat exchanger 15*b* is expanded by the expansion device 16*b* into a low-pressure two-phase refrigerant, which passes through the expansion device 16*a* and flows into the intermediate heat exchanger 15*a* serving as an evaporator. In the intermediate heat exchanger 15*a*, the low-pressure two-phase refrigerant receives heat from the heat medium circulating in the heat medium circuit B to cool the heat medium, and turns into a low-pressure gas refrigerant. The gas refrigerant flows out of the intermediate heat exchanger 15*a*, passes through the second refrigerant flow switching device 18*a*, flows out of the heat medium relay unit 3, passes through the refrigerant pipe 4, and flows into the outdoor unit 1 again. After flowing into the outdoor unit 1, the refrigerant passes through the check valve 13*d*, the first refrigerant flow switching device 11, and the accumulator 19, and is sucked into the compressor 10 again.

The second refrigerant flow switching device 18*a* communicates with a low-pressure pipe, whereas the second refrigerant flow switching device 18*b* communicates with a high-pressure side pipe. The opening degree of the expansion device 16*b* is controlled such that a degree of superheat, which is obtained as a difference between a temperature detected by the third temperature sensor 35*a* and a temperature detected by the third temperature sensor 35*b*, is constant. The expansion device 16*a* is fully opened and the opening and closing device 17*b* is closed. The opening degree of the expansion device 16*b* may be controlled such that a degree of subcooling, which is obtained as a difference between a saturation temperature determined by converting a pressure detected by the pressure sensor 36 and a temperature detected by the third temperature sensor 35*d*, is constant. The expansion device 16*b* may be fully opened, and the degree of superheat or subcooling may be controlled with the expansion device 16*a*.

Next, the flow of the heat medium in the heat medium circuit B will be described.

In the cooling main operation mode, the intermediate heat exchanger 15*b* transfers heating energy of the heat-source-side refrigerant to the heat medium, and the pump 21*b* causes the heated heat medium to flow through the pipe 5. Also in the cooling main operation mode, the intermediate heat exchanger 15*a* transfers cooling energy of the heat-source-side refrigerant to the heat medium, and the pump 21*a* causes the cooled heat medium to flow through the pipe 5. After being pressurized by the pump 21*a* and the pump 21*b* and flowing out thereof, the heat medium passes through the second heat medium flow switching device 23*a* and the second heat medium flow switching device 23*b*, and flows into the use-side heat exchanger 26*a* and the use-side heat exchanger 26*b*.

In the use-side heat exchanger 26*b*, the heat medium transfers heat to the indoor air to heat the indoor space 7. In the use-side heat exchanger 26*a*, the heat medium receives heat from the indoor air to cool the indoor space 7. The actions of the heat medium flow control device 25*a* and the heat medium flow control device 25*b* allow the heat medium to flow into the use-side heat exchanger 26*a* and the use-side heat exchanger 26*b* while controlling a flow rate of the heat medium to a level necessary to compensate for an air conditioning load required in the indoor space. After passing through the use-side heat exchanger 26*b* and slightly lowering its temperature, the heat medium passes through the heat medium flow control device 25*b* and the first heat medium flow switching device 22*b*, flows into the intermediate heat exchanger 15*b*, and is sucked into the pump 21*b* again. After passing through the use-side heat exchanger 26*a* and slightly increasing its temperature, the heat medium passes through the heat medium flow control device 25*a* and the first heat medium flow switching device 22*a*, flows into the intermediate heat exchanger 15*a*, and is sucked into the pump 21*a* again.

During this process, the actions of the first heat medium flow switching devices 22 and the second heat medium flow switching devices 23 allow the warm heat medium and the cool heat medium to be introduced, without being mixed together, into the respective use-side heat exchangers 26 each having either a heating load or a cooling load. In the pipes 5 of the use-side heat exchangers 26, on both the heating side and the cooling side, the heat medium flows in the direction from the second heat medium flow switching devices 23 through the heat medium flow control devices 25 to the first heat medium flow switching devices 22. The air conditioning load required in the indoor space 7 can be compensated by controlling on the heating side a difference between a temperature detected by the first temperature sensor 31*b* and a temperature detected by the corresponding second temperature sensor 34 such that the difference is maintained as a target value, and by controlling on the cooling side a difference between a temperature detected by the first temperature sensor 31*a* and a temperature detected by the corresponding second temperature sensor 34 such that the difference is maintained as a target value.

In the execution of the cooling main operation mode, since it is not necessary to supply the heat medium to any use-side heat exchanger 26 having no heat load (including thermo-off), the corresponding heat medium flow control device 25 closes the passage to prevent the heat medium from flowing into the use-side heat exchanger 26. In FIG. 15, the heat medium is supplied to the use-side heat exchanger 26*a* and the use-side heat exchanger 26*b* because they have a heat load. The use-side heat exchanger 26*c* and the use-side heat exchanger 26*d* have no heat load, and the corresponding heat medium flow control device 25*c* and heat medium flow control device 25*d* are fully closed. When a heat load is generated in the use-side heat exchanger 26*c* or the use-side heat exchanger 26*d*, the heat medium flow control device 25*c* or the heat medium flow control device 25*d* may be opened to allow the heat medium to circulate.

[Heating Main Operation Mode]

Figure 16:
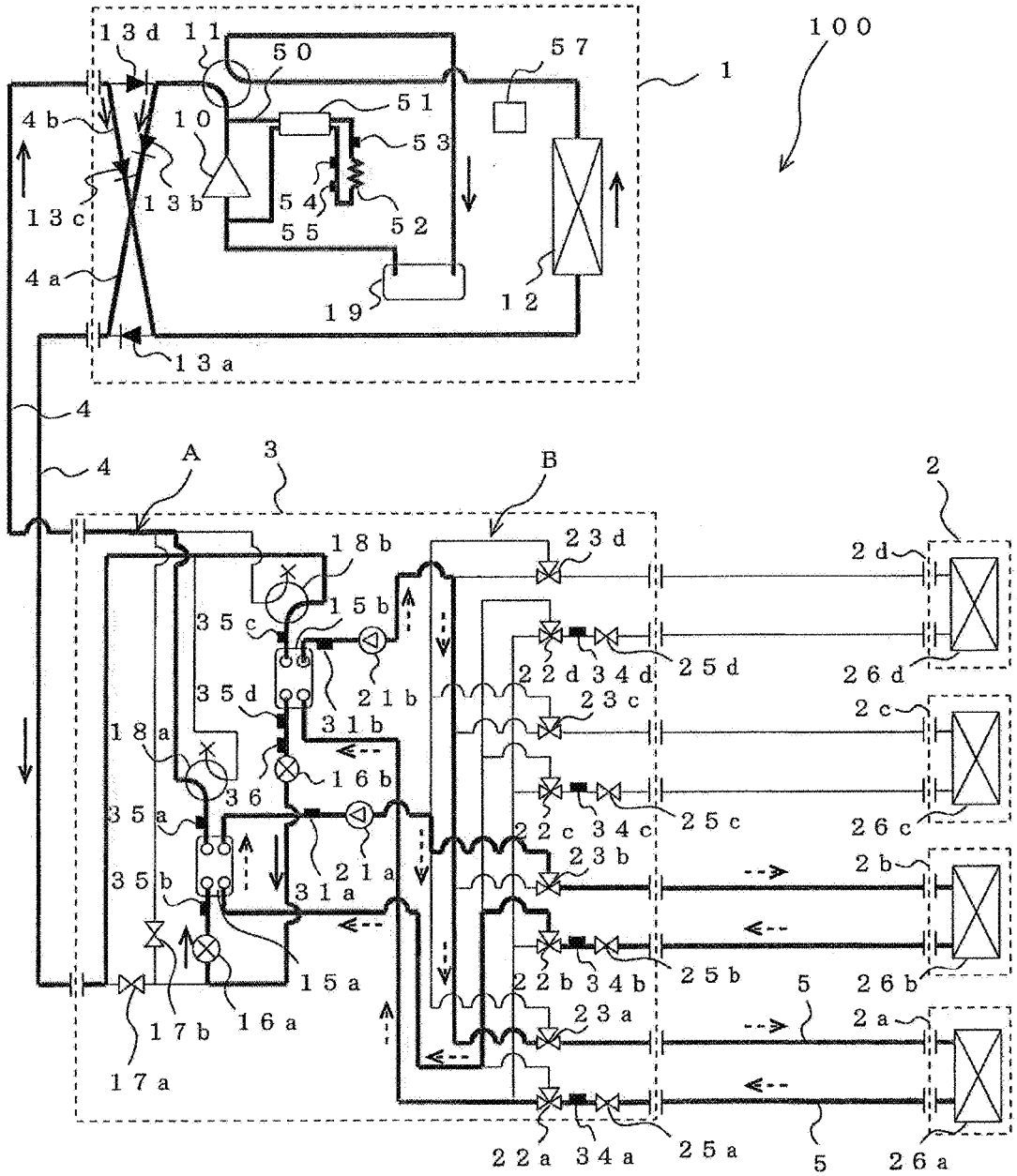
FIG. 16 is a refrigerant circuit diagram illustrating flows of refrigerant in a heating main operation mode of the air-conditioning apparatus illustrated in FIG. 2.

FIG. 16 is a refrigerant circuit diagram illustrating flows of refrigerant in the heating main operation mode of the air-conditioning apparatus 100 illustrated in FIG. 2. FIG. 16 illustrates the heating main operation mode using an example where a heating energy load is generated in the use-side heat exchanger 26*a* and a cooling energy load is generated in the use-side heat exchanger 26*b*. In FIG. 16, pipes indicated by thick lines are those through which the refrigerants (the heat-source-side refrigerant and the heat medium) circulate. Also in FIG. 16, the direction of flow of the heat-source-side refrigerant is indicated by solid arrows, and the direction of flow of the heat medium is indicated by dashed arrows.

In the heating main operation mode illustrated in FIG. 16, the outdoor unit 1 switches the first refrigerant flow switching device 11 such that the heat-source-side refrigerant discharged from the compressor 10 flows into the heat medium relay unit 3 without passing through the heat-source-side heat exchanger 12. The heat medium relay unit 3 drives the pump 21*a* and the pump 21*b*, opens the heat medium flow control device 25*a* and the heat medium flow control device 25*b*, and fully closes the heat medium flow control device 25*c* and the heat medium flow control device 25*d*, so that the heat medium circulates between the intermediate heat exchanger 15*a* and the use-side heat exchanger 26*b* and between the intermediate heat exchanger 15*b* and the use-side heat exchanger 26*a*.

First, the flow of the heat-source-side refrigerant in the refrigerant circuit A will be described.

A low-temperature low-pressure refrigerant is compressed by the compressor 10 into a high-temperature high-pressure gas refrigerant and discharged. The high-temperature high-pressure gas refrigerant discharged from the compressor 10 partially flows into the bypass 50 and into the heat exchanging device 51, exchanges heat with a low-temperature low-pressure refrigerant, and turns into a high-pressure liquid refrigerant. The high-pressure liquid refrigerant is pressure-reduced by the expansion device 52, turns into a two-phase gas-liquid low-pressure refrigerant, flows into the heat exchanging device 51, turns into a gas refrigerant under the influence of a high-temperature high-pressure refrigerant, joins a gas refrigerant from the accumulator 19, and is sucked into the compressor 10. On the other hand, the remaining part of the high-temperature high-pressure gas refrigerant discharged from the compressor 10 passes through the first refrigerant flow switching device 11 and the check valve 13*b*, and flows out of the outdoor unit 1. The high-temperature high-pressure gas refrigerant flowing out of the outdoor unit 1 passes through the refrigerant pipe 4, and flows into the heat medium relay unit 3. After flowing into the heat medium relay unit 3, the high-temperature high-pressure gas refrigerant passes through the second refrigerant flow switching device 18*b* and flows into the intermediate heat exchanger 15*b* serving as a condenser.

In the intermediate heat exchanger 15*b*, the gas refrigerant turns into a liquid refrigerant while transferring heat to the heat medium circulating in the heat medium circuit B. The refrigerant flowing out of the intermediate heat exchanger 15*b* is expanded by the expansion device 16*b* into a low-pressure two-phase refrigerant. The low-pressure two-phase refrigerant passes through the expansion device 16*a* and flows into the intermediate heat exchanger 15*a* serving as an evaporator. In the intermediate heat exchanger 15*a*, the low-pressure two-phase refrigerant evaporates by receiving heat from the heat medium circulating in the heat medium circuit B, and cools the heat medium. The low-pressure two-phase refrigerant flows out of the intermediate heat exchanger 15*a*, passes through the second refrigerant flow switching device 18*a*, flows out of the heat medium relay unit 3, and flows into the outdoor unit 1 again.

After flowing into the outdoor unit 1, the refrigerant passes through the check valve 13*c* and flows into the heat-source-side heat exchanger 12 serving as an evaporator. In the heat-source-side heat exchanger 12, the refrigerant receives heat from the outdoor air and turns into a low-temperature low-pressure gas refrigerant. The low-temperature low-pressure gas refrigerant flowing out of the heat-source-side heat exchanger 12 passes through the first refrigerant flow switching device 11 and the accumulator 19, and is sucked into the compressor 10 again.

The second refrigerant flow switching device 18*a* communicates with a low-pressure side pipe, whereas the second refrigerant flow switching device 18*b* communicates with a high-pressure side pipe. The opening degree of the expansion device 16*b* is controlled such that a degree of subcooling, which is obtained as a difference between a saturation temperature determined by converting a pressure detected by the pressure sensor 36 and a temperature detected by the third temperature sensor 35*b*, is constant. The expansion device 16*a* is fully opened and the opening and closing device 17*a* is closed. The expansion device 16*b* may be fully opened, and the degree of subcooling may be controlled with the expansion device 16*a*.

Next, the flow of the heat medium in the heat medium circuit B will be described.

In the heating main operation mode, the intermediate heat exchanger 15*b* transfers heating energy of the heat-source-side refrigerant to the heat medium, and the pump 21*b* causes the heated heat medium to flow through the pipe 5. Also in the heating main operation mode, the intermediate heat exchanger 15*a* transfers cooling energy of the heat-source-side refrigerant to the heat medium, and the pump 21*a* causes the cooled heat medium to flow through the pipe 5. After being pressurized by the pump 21*a* and the pump 21*b* and flowing out thereof, the heat medium passes through the second heat medium flow switching device 23*a* and the second heat medium flow switching device 23*b*, and flows into the use-side heat exchanger 26*a* and the use-side heat exchanger 26*b*.

In the use-side heat exchanger 26*b*, the heat medium receives heat from the indoor air to cool the indoor space 7. In the use-side heat exchanger 26*a*, the heat medium transfers heat to the indoor air to heat the indoor space 7. The actions of the heat medium flow control device 25*a* and the heat medium flow control device 25*b* allow the heat medium to flow into the use-side heat exchanger 26*a* and the use-side heat exchanger 26*b* while controlling a flow rate of the heat medium to a level necessary to compensate for an air conditioning load required in the indoor space. After passing through the use-side heat exchanger 26*b* and slightly increasing its temperature, the heat medium passes through the heat medium flow control device 25*b* and the first heat medium flow switching device 22*b*, flows into the intermediate heat exchanger 15*a*, and is sucked into the pump 21*a* again. After passing through the use-side heat exchanger 26*a* and slightly lowering its temperature, the heat medium passes through the heat medium flow control device 25*a* and the first heat medium flow switching device 22*a*, flows into the intermediate heat exchanger 15*b*, and is sucked into the pump 21*b* again.

During this process, the actions of the first heat medium flow switching devices 22 and the second heat medium flow switching devices 23 allow the warm heat medium and the cool heat medium to be introduced, without being mixed together, into the respective use-side heat exchangers 26 each having either a heating load or a cooling load. In the pipes 5 of the use-side heat exchangers 26, on both the heating side and the cooling side, the heat medium flows in the direction from the second heat medium flow switching devices 23 through the heat medium flow control devices 25 to the first heat medium flow switching devices 22. The air conditioning load required in the indoor space 7 can be compensated by controlling on the heating side a difference between a temperature detected by the first temperature sensor 31*b* and a temperature detected by the corresponding second temperature sensor 34 such that the difference is maintained as a target value, and by controlling on the cooling side a difference between a temperature detected by the first temperature sensor 31*a* and a temperature detected by the corresponding second temperature sensor 34 such that the difference is maintained as a target value.

In the execution of the heating main operation mode, since it is not necessary to supply the heat medium to any use-side heat exchanger 26 having no heat load (including thermo-off), the corresponding heat medium flow control device 25 closes the passage to prevent the heat medium from flowing into the use-side heat exchanger 26. In FIG. 16, the heat medium is supplied to the use-side heat exchanger 26*a* and the use-side heat exchanger 26*b* because they have a heat load. The use-side heat exchanger 26*c* and the use-side heat exchanger 26*d* have no heat load, and the corresponding heat medium flow control device 25*c* and heat medium flow control device 25*d* are fully closed. When a heat load is generated in the use-side heat exchanger 26*c* or the use-side heat exchanger 26*d*, the heat medium flow control device 25*c* or the heat medium flow control device 25*d* may be opened to allow the heat medium to circulate.

[Refrigerant Pipes 4]

As described above, the air-conditioning apparatus 100 according to Embodiment has several operation modes, where the heat-source-side refrigerant flows through the refrigerant pipes 4 that connect the outdoor unit 1 and the heat medium relay unit 3.

[Pipes 5]

In the several operation modes performed by the air-conditioning apparatus 100 according to Embodiment, the heat medium, such as water or antifreeze, flows through the pipes 5 that connect the heat medium relay unit 3 and the indoor units 2.

[Heat-Source-Side Refrigerant]

Embodiment has dealt with an example where a mixture of R32 and HFO1234yf is used as the heat-source-side refrigerant. Even in the case of another two-component non-azeotropic refrigerant mixture, using the control flow for calculating a refrigerant composition according to Embodiment makes it possible to calculate a circulation composition with high accuracy.

[Heat Medium]

Examples of the heat medium that can be used include brine (antifreeze), water, a mixed solution of brine and water, and a mixed solution of water and an anti-corrosive additive. Thus, in the air-conditioning apparatus 100, even if the heat medium leaks through any indoor unit 2 into the indoor space 7, since the heat medium is safe, it is possible to contribute to improved safety.

If the state (heating or cooling) of each of the intermediate heat exchanger 15*b* and the intermediate heat exchanger 15*a* changes in the cooling main operation mode and the heating main operation mode, warm water is cooled to a lower temperature and cool water is heated to a higher temperature, and this results in waste of energy. Therefore, the air-conditioning apparatus 100 is configured such that in both the cooling main operation mode and the heating main operation mode, the intermediate heat exchanger 15*b* is always on the heating side and the intermediate heat exchanger 15*a* is always on the cooling side.

When both a heating load and a cooling load are generated in the use-side heat exchangers 26, the first heat medium flow switching device 22 and the second heat medium flow switching device 23 corresponding to a use-side heat exchanger 26 in heating operation are switched to passages connected to the intermediate heat exchanger 15*b* designed for heating, and the first heat medium flow switching device 22 and the second heat medium flow switching device 23 corresponding to a use-side heat exchanger 26 in cooling operation are switched to passages connected to the intermediate heat exchanger 15*a* designed for cooling. This allows each indoor unit 2 to freely perform both the heating operation and the cooling operation.

Although the air-conditioning apparatus 100 has been described as being capable of performing a cooling and heating mixed operation, the air-conditioning apparatus 100 is not limited to this. For example, the same effect can be achieved even if the air-conditioning apparatus 100 includes one intermediate heat exchanger 15 and one expansion device 16 to which a plurality of heat medium flow control devices 25 and a plurality of use-side heat exchangers 26 are connected in parallel, so that the air-conditioning apparatus 100 can perform only one of the heating operation and the cooling operation.

The same applies to the case where only one use-side heat exchanger 26 and only one heat medium flow control device 25 are connected. The intermediate heat exchangers 15 and the expansion devices 16 may be replaced by a plurality of components having the same functions as those of the intermediate heat exchangers 15 and the expansion devices 16. Although the heat medium flow control devices 25 are included in the heat medium relay unit 3 in the example described above, the configuration is not limited to this. Each heat medium flow control device 25 may be included in the indoor unit 2, or may be configured as a unit separate from both the heat medium relay unit 3 and the indoor unit 2.

Although the heat-source-side heat exchanger 12 and each of the use-side heat exchangers 26 are each typically provided with an air-sending device which sends air to promote condensation or evaporation, the configuration is not limited to this. For example, a panel heater that uses radiation may be used as the use-side heat exchanger 26, and a water-cooled heat exchanger that transfers heat through water or antifreeze may be used as the heat-source-side heat exchanger 12. That is, the heat-source-side heat exchanger 12 and the use-side heat exchanger 26 may be of any types, as long as they are configured to be capable of transferring or receiving heat.

The invention claimed is:

1. An air-conditioning apparatus including a compressor, a first heat exchanger, an expansion device, and a second heat exchanger that are connected by a refrigerant pipe to form a refrigeration cycle, the air-conditioning apparatus using a non-azeotropic refrigerant mixture as a refrigerant for the refrigeration cycle, the air-conditioning apparatus comprising:

a bypass connected to bypass the compressor;

a bypass heat exchanger provided in the bypass and configured to cool the refrigerant flowing from the compressor into the bypass;

a second expansion device provided in the bypass and configured to reduce a pressure of the refrigerant cooled by the bypass heat exchanger;

refrigerant state detecting devices configured to detect a temperature of the refrigerant flowing into the second expansion device within ±1 ° C., a temperature of the refrigerant flowing out of the second expansion device within ±0.5 ° C., and a pressure of the refrigerant sucked into the compressor within ±0.01 MPa; and a computing device configured to calculate a composition of the refrigerant circulating in the refrigeration cycle on the basis of each of the detection results of the refrigerant state detecting devices, the computing device is configured to read each of detection results from an inlet temperature sensor, an outlet temperature sensor, and an outlet pressure sensor, tentatively set a circulating refrigerant composition value as a set value, output a physical property value from a physical property table corresponding to the set value, calculate an inlet liquid enthalpy (Hin) of the refrigerant flowing into the second expansion device from the detection results of an inlet temperature sensor and from the physical property table, calculate a saturated liquid enthalpy (Hls) and a saturated gas enthalpy (Hgs) of a refrigerant flowing out of the second expansion device from the detection results of an outlet temperature sensor and from the the physical property table, calculate a Quality Xr from the inlet liquid enthalpy (Hin), the saturated liquid enthalpy (Hls), and the saturated gas enthalpy (Hgs), the Quality Xr is calculated by dividing a first difference between the inlet liquid enthalpy (Hin) and the saturated liquid enthalpy (Hls) by a second difference between the saturated gas enthalpy (Hgs) and the saturated liquid enthalpy (Hls), calculate a first concentration (XR32) of a liquid refrigerant flowing out of the second expansion device and a second concentration (YR32) of a gas refrigerant flowing out of the second expansion device from each of the detection results of the outlet temperature sensor, the outlet pressure sensor, and the physical property table, calculate a Refrigerant Composition α from Quality Xr, XR32, YR32 by the following formula:

$$\text{Refrigerant Composition } \alpha=(1-Xr)*XR32+Xr*YR32,$$

output the Refrigerant Composition α, without repeatedly calculating the inlet liquid enthalpy (Hin), the saturated liquid enthalpy (Hls), the saturated gas enthalpy (Hgs), the Quality Xr, the first concentration (XR32), the second concentration (YR32) and the Refrigerant Composition α; and control at least one of the expansion device, the second expansion device, the compressor, the first heat exchanger, and the second heat exchanger in accordance with the Refrigerant Composition α calculated by the computing device.

2. The air-conditioning apparatus of claim 1, further comprising:

an outdoor unit including the compressor, a first refrigerant flow switching device, and the first heat exchanger;

a heat medium relay unit including the second heat exchanger, a plurality of expansion devices, and a plurality of second refrigerant flow switching devices; and at least one indoor unit including a use-side heat exchanger, wherein the compressor, the first refrigerant flow switching device, the first heat exchanger, the second heat exchanger, the plurality of expansion devices, and the second refrigerant flow switching devices are connected by the refrigerant pipe to form the refrigeration cycle; and the second heat exchanger and the use-side heat exchanger are connected by a heat medium pipe to form a heat medium circuit in which a heat medium different from the refrigerant circulates.

3. The air-conditioning apparatus of claim 1, wherein the computing device sets the composition of the refrigerant in advance, and calculates the inlet liquid enthalpy on the basis of the set composition of the refrigerant and the temperature of the refrigerant flowing into the second expansion device.

4. The air-conditioning apparatus of claim 1, wherein the bypass includes an opening and closing valve.

5. The air-conditioning apparatus of claim 1, wherein a refrigerant mixture of R32 and HFO1234yf or a refrigerant mixture of R32and HFO1234ze is used as the non-azeotropic refrigerant mixture.

6. A computer-implemented method for controlling an air-conditioning apparatus, comprising:

reading each of detection results from an inlet temperature sensor, an outlet temperature sensor, and an outlet pressure sensor;

tentatively setting a circulating refrigerant composition value as a set value;

outputting a physical property value from a physical property table corresponding to the set value;

calculating an inlet liquid enthalpy (Hin) of the refrigerant flowing into a second expansion device from the detection results of an inlet temperature sensor and from the physical property table;

calculating a saturated liquid enthalpy (Hls) and a saturated gas enthalpy (Hgs) of a refrigerant flowing out of the second expansion device from the detection results of an outlet temperature sensor and from the physical property table;

calculating a Quality Xr from the inlet liquid enthalpy (Hin), the saturated liquid enthalpy (Hls), and the saturated gas enthalpy (Hgs), the Quality Xr is calculated by dividing a first difference between the inlet liquid enthalpy (Hin) and the saturated liquid enthalpy (Hls) by a second difference between the saturated gas enthalpy (Hgs) and the saturated liquid enthalpy (Hls);

calculating a first concentration (XR32) of a liquid refrigerant flowing out of the second expansion device and a second concentration (YR32) of a gas refrigerant flowing out of the second expansion device from each of the detection results of the outlet temperature sensor, the outlet pressure sensor, and the physical property table;

calculating a Refrigerant Composition α from Quality Xr, XR32, YR32 by the following formula:

$$\text{Refrigerant Composition } \alpha=(1-Xr)*XR32+Xr*YR32;$$

outputting the Refrigerant Composition α, without repeatedly calculating the inlet liquid enthalpy (Hin), the saturated liquid enthalpy (Hls), the saturated gas enthalpy (Hgs), the Quality Xr, the first concentration (XR32), the second concentration (YR32) and the Refrigerant Composition α; and controlling at least one of a first expansion device, the second expansion device, a compressor, a first heat exchanger, and a second heat exchanger in accordance with the Refrigerant Composition α that is calculated.

7. An air-conditioning apparatus including a compressor, a first heat exchanger, an expansion device, and a second heat exchanger that are connected by a refrigerant pipe to form a refrigeration cycle, the air-conditioning apparatus using a non-azeotropic refrigerant mixture as a refrigerant for the refrigeration cycle, the air-conditioning apparatus comprising:

a bypass connected to bypass the compressor;

a bypass heat exchanger provided in the bypass and configured to cool the refrigerant flowing from the compressor into the bypass;

a second expansion device provided in the bypass and configured to reduce a pressure of the refrigerant cooled by the bypass heat exchanger;

refrigerant state detecting devices configured to detect a temperature of the refrigerant flowing into the second expansion device, a temperature of the refrigerant flowing out of the second expansion device, and a pressure of the refrigerant sucked into the compressor; and a computing device configured to calculate a composition of the refrigerant circulating in the refrigeration cycle on the basis of each of the detection results of the refrigerant state detecting devices, the computing device is configured to read each of detection results from an inlet temperature sensor, an outlet temperature sensor, and an outlet pressure sensor, tentatively set a circulating refrigerant composition value as a set value, output a physical property value from a physical property table corresponding to the set value, calculate an inlet liquid enthalpy (Hin) of the refrigerant flowing into the second expansion device from the detection results of an inlet temperature sensor and from the physical property table, calculate a saturated liquid enthalpy (Hls) and a saturated gas enthalpy (Hgs) of a refrigerant flowing out of the second expansion device from the detection results of an outlet temperature sensor and from the physical property table, calculate a Quality Xr from the inlet liquid enthalpy (Hin), the saturated liquid enthalpy (Hls), and the saturated gas enthalpy (Hgs), the Quality Xr is calculated by dividing a first difference between the inlet liquid enthalpy (Hin) and the saturated liquid enthalpy (Hls) by a second difference between the saturated gas enthalpy (Hgs) and the saturated liquid enthalpy (Hls), calculate a first concentration (XR32) of a liquid refrigerant flowing out of the second expansion device and a second concentration (YR32) of a gas refrigerant flowing out of the second expansion device from each of the detection results of the outlet temperature sensor, the outlet pressure sensor, and the physical property table, calculate a Refrigerant Composition α from Quality Xr, XR32, YR32by the following formula:

$$\text{Refrigerant Composition } \alpha=(1-Xr)*XR32+Xr*YR32,$$

output the Refrigerant Composition α, without repeatedly calculating the inlet liquid enthalpy (Hin), the saturated liquid enthalpy (Hls), the saturated gas enthalpy (Hgs), the Quality Xr, the first concentration (XR32), the second concentration (YR32) and the Refrigerant Composition α; and control at least one of the expansion device, the second expansion device, the compressor, the first heat exchanger, and the second heat exchanger in accordance with the Refrigerant Composition α calculated by the computing device.

* * * * *